US010672601B2

(12) United States Patent
Northen et al.

(10) Patent No.: US 10,672,601 B2
(45) Date of Patent: Jun. 2, 2020

(54) DETECTING COMPOUNDS IN MICROFLUIDIC DROPLETS USING MASS SPECTROMETRY

(71) Applicant: The Regents of the University of California, Oakland, CA (US)

(72) Inventors: Trent Russell Northen, Walnut Creek, CA (US); Joshua Vance Heinemann, Pittsburg, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 16/307,698

(22) PCT Filed: Jun. 6, 2017

(86) PCT No.: PCT/US2017/036192
§ 371 (c)(1),
(2) Date: Dec. 6, 2018

(87) PCT Pub. No.: WO2017/214177
PCT Pub. Date: Dec. 14, 2017

(65) Prior Publication Data

US 2019/0304763 A1 Oct. 3, 2019

Related U.S. Application Data

(60) Provisional application No. 62/347,002, filed on Jun. 7, 2016.

(51) Int. Cl.
*H01J 49/16* (2006.01)
*H01J 49/04* (2006.01)
(Continued)

(52) U.S. Cl.
CPC .... *H01J 49/0431* (2013.01); *B01L 3/502792* (2013.01); *H01J 49/164* (2013.01);
(Continued)

(58) Field of Classification Search
CPC ..... B01L 2200/0689; B01L 2300/0645; B01L 2300/0887; B01L 2300/12;
(Continued)

(56) References Cited

U.S. PATENT DOCUMENTS

2002/0100714 A1* 8/2002 Staats ..... B01L 3/5027 210/85
2003/0224531 A1* 12/2003 Brennen ..... B01L 3/5025 436/180

(Continued)

OTHER PUBLICATIONS

Shih, Steve CC, et al. "Dried blood spot analysis by digital microfluidics coupled to nanoelectrospray ionization mass spectrometry." Analytical chemistry 84.8 (2012): 3731-3738 (Year: 2012).*

(Continued)

*Primary Examiner* — Wyatt A Stoffa
(74) *Attorney, Agent, or Firm* — Sheppard, Mullin, Richter & Hampton LLP

(57) ABSTRACT

Disclosed herein are devices and methods for detecting compounds in droplets using mass spectrometry. In some embodiments, the device comprises: a microfluidics-MS (microMS) device, wherein the microMS device comprises: a droplet-to-digital microfluidic device, wherein the droplet-to-digital microfluidic device comprises: a glass layer; an electrode layer comprising chrome electrodes etched onto one side of the glass layer; a dielectric layer configured for electrowetting; and a microfluidics layer comprising channels, pockets, and a droplet generator, for example a T-junction droplet generator, wherein the pockets are connected to the channels; and a mass spectrometry plate, wherein the mass spectrometry plate is reversibly sealed to the microfluidic device.

19 Claims, 12 Drawing Sheets

(51) Int. Cl.
*B01L 3/00* (2006.01)
*H01J 49/00* (2006.01)
*H01J 49/26* (2006.01)

(52) U.S. Cl.
CPC ..... *B01L 2200/0689* (2013.01); *B01L 2300/0645* (2013.01); *B01L 2300/0816* (2013.01); *B01L 2300/0822* (2013.01); *B01L 2300/0887* (2013.01); *B01L 2300/12* (2013.01); *B01L 2400/0427* (2013.01); *H01J 49/0018* (2013.01); *H01J 49/26* (2013.01)

(58) Field of Classification Search
CPC ..... B01L 2400/0427; B01L 3/502792; H01J 49/018; H01J 49/0431; H01J 49/164
See application file for complete search history.

(56) References Cited

U.S. PATENT DOCUMENTS

2005/0047969 A1* 3/2005 Zhao ..... B01L 3/0268 422/503
2006/0103051 A1* 5/2006 Staats ..... B01L 3/0268 264/297.2
2007/0145262 A1* 6/2007 Tai ..... H01J 49/0018 250/288
2008/0128608 A1* 6/2008 Northen ..... H01J 49/0413 250/282
2009/0181864 A1* 7/2009 Nguyen ..... B01L 3/502792 506/33
2010/0018584 A1* 1/2010 Bransky ..... B01F 3/0807 137/2
2010/0081578 A1* 4/2010 Wheeler ..... B01L 3/502784 506/7
2012/0018306 A1* 1/2012 Srinivasan ..... C07K 1/1136 204/547
2012/0083046 A1* 4/2012 Watson ..... B01L 3/502715 436/177
2012/0145890 A1 6/2012 Goodlett et al.
2013/0327936 A1* 12/2013 Ramsey ..... B05B 5/025 250/282
2014/0047907 A1* 2/2014 Murphy ..... H01J 49/0431 73/61.55
2014/0247115 A1* 9/2014 Leclerc ..... A61B 5/1172 340/5.82
2016/0114320 A1* 4/2016 Pollack ..... B01F 11/0071 204/450
2017/0156623 A1* 6/2017 Chu ..... B01L 3/502707
2017/0227546 A1* 8/2017 Vertes ..... H01J 49/0418
2017/0354973 A1* 12/2017 Sustarich ..... G01N 35/08
2019/0194736 A1* 6/2019 Blainey ..... C12M 23/12
2019/0210026 A1* 7/2019 Jebrail ..... B01L 3/502784

OTHER PUBLICATIONS

Heinemann et al., "On-chip integration of droplet microfluidics and nanostructure-initiator mass spectrometry for enzyme screening," *Lab on a Chip*, Royal Society of Chemistry, Sep. 20, 2016, in 9 pages.
International Search Report and Written Opinion dated Sep. 11, 2017 in International Application No. PCT/US2017/036192.
International Preliminary Report on Patentability dated Dec. 11, 2018 in International Application No. PCT/US2017/036192.

* cited by examiner

DETECTING COMPOUNDS IN MICROFLUIDIC DROPLETS USING MASS SPECTROMETRY

RELATED APPLICATION

The present application is a U.S. national phase application under 35 U.S.C. § 371 of International Application No. PCT/US2017/036192, filed on Jun. 6, 2017 and published on Dec. 14, 2017, which claims priority to U.S. Provisional Application No. 62/347,002, filed on Jun. 7, 2016. The content of each of these related applications is incorporated herein by reference herein in its entirety.

STATEMENT REGARDING FEDERALLY SPONSORED R&D

This invention was made with government support under grant No. DE-AC02-05CH11231 awarded by the U.S. Department of Energy, grant Nos. MCB0646499 and MCB102248 awarded by National Science Foundation, and grant Nos. P20 RR-020185 and P20 RR-024237 awarded by National Institute of Health. The government has certain rights in the invention.

BACKGROUND

Field

The present disclosure relates generally to the field of chemical biology, and more particularly to compound screening.

Description of the Related Art

Methods and techniques based on microfluidics can be used for enzymatic functional screening. However, these microfluidics-based methods and techniques may have limited scope of use because the enzymatic reactions are monitored or analyzed by optical detections. Methods and techniques based on mass spectrometry, for example nanostructure-initiator mass spectrometry, can be used to measure the substrates and products of enzymatic reactions. However, human sample preparation may limit the throughput of these mass spectrometry-based methods and techniques. There is a need for integrating microfluidics with mass spectrometry.

SUMMARY

Disclosed herein are devices for detecting compounds in microfluidic droplets using mass spectrometry. In some embodiments, the device comprises: a microfluidic device; and a mass spectrometry plate, wherein the mass spectrometry plate is reversibly sealed to the microfluidic device. The microfluidic device can comprise a droplet-to-digital microfluidic device.

In some embodiments, the droplet-to-digital microfluidic device comprises: a glass layer; an electrode layer; a dielectric layer; and a microfluidics layer. The glass layer can be on a first side of the electrode layer, and the dielectric layer can be on a second side of the electrode layer. The electrode layer can be on a first side of the dielectric layer, and the microfluidics layer can on a second side of the dielectric layer. The dielectric layer can be on a first side of the microfluidics layer, and the mass spectrometry plate can be on a second side of the microfluidics layer.

In some embodiments, the electrode layer comprises electrodes etched onto one side of the glass layer. The electrodes can comprise chrome electrodes. The electrode layer can be configured to manipulate droplets in the microfluidics layer.

In some embodiments, the glass layer comprises fluidic access ports. In some embodiments, the dielectric layer can be configured for electrowetting. In some embodiments, the microfluidics layer comprises channels. Depths of some of the channels can be 5-250 μm. Widths of some of the channels can be 5-500 μm. In some embodiments, the microfluidics layer comprises a droplet generator, wherein the generator is connected to the channels. The droplet generator can be a T-junction droplet generator. The microfluidics layer can comprise pockets connected to the channels of the microfluidics layer.

In some embodiments, the mass spectrometry plate can be reversibly sealed to the microfluidic device with a rubbery seal. The mass spectrometry plate can be reversibly sealed at 1.5-9 MPa. The mass spectrometry plate can be reversibly sealed at a pressure higher than an inner pressure of the microfluidics device.

In some embodiments, the mass spectrometry plate comprises micropatterns. The micropatterns can be configured for correct alignment of the mass spectrometry plate with the microfluidics device and allow targeted droplet deposition. In some embodiments, the mass spectrometry plate comprises at least 640 mass spectrometry pads, wherein the microfluidics layer comprises at least 640 pockets. The mass spectrometry plate can be fabricated using Reactive Ion Etching.

Disclosed herein are methods for detecting compounds in droplets using mass spectrometry. In some embodiments, the method comprises: providing a microfluidics-mass spectrometry (microMS) device, comprising: a droplet-to-digital microfluidic device, wherein the droplet-to-digital microfluidic device comprises: a glass layer, wherein the glass layer comprises fluidic access ports; an electrode layer, wherein the electrode layer comprises chrome electrodes etched onto one side of the glass layer; a dielectric layer, wherein the dielectric layer is configured for electrowetting; and a microfluidics layer, wherein the microfluidics layer comprises channels, pockets, and a droplet generator, wherein the pockets are connected to the channels; a mass spectrometry plate, wherein the mass spectrometry plate is reversibly sealed to the microfluidic device; and producing droplets comprising one or more compounds using the droplet generator of the microMS device; and generating mass spectra for the droplets to detect one or more compounds in the droplets.

In some embodiments, the glass layer can be on a first side of the electrode layer, and wherein the dielectric layer can be on a second side of the electrode layer. The electrode layer can be on a first side of the dielectric layer, and the microfluidics layer can be on a second side of the dielectric layer. The dielectric layer can be on a first side of the microfluidics layer, and the mass spectrometry plate can be on a second side of the microfluidics layer.

In some embodiments, the method comprises manipulating the droplets generated using the electrode layer. Manipulating the droplets using the electrode layer can comprise splitting at least one of the droplets, mixing at least two of the droplets, moving at least one of the droplets, or any combination thereof.

In some embodiments, depths of some of the channels can be 5-250 μm, and wherein widths of some of the channels can be 5-500 μm. The mass spectrometry plate can be reversibly sealed to the microfluidic device with a rubbery seal at 1.5-9 MPa. In some embodiments, the mass spectrometry plate comprises micropatterns. The method can comprise: aligning the mass spectrometry plate with the microfluidics device to allow targeted droplet deposition using the micropatterns.

In some embodiments, the mass spectrometry plate comprises 640 mass spectrometry pads, and the microfluidics layer comprises 640 pockets. In some embodiments, the method comprises depositing the droplets into the pockets, wherein the volume of at least one of the one or more mixtures is about 1 microliter, about 1 nanoliter, or about 1 picoliter. The method can comprise manipulating the droplets from the pockets into the mass spectrometry pads.

In some embodiments, at least one of the mass spectra is generated using soft ionization mass spectrometry (MS). At least one of the mass spectra is generated using electrospray ionization MS (ESI-MS), liquid chromatography ESI-MS, nanostructure-initiator MS, fast atom bombardment MS, chemical ionization MS, atmospheric-pressure chemical ionization MS, matrix-assisted laser desorption/ionization MS, or any combination thereof.

BRIEF DESCRIPTION OF THE DRAWINGS

FIG. 1A shows a non-limiting exemplary electrode and fluidics design of layer iii in FIG. 1C. FIG. 1A, panel 1 shows a non-limiting exemplary with arrows showing direction of flow. FIG. 1A panel 2 shows a non-limiting exemplary μNIMS pocket. FIG. 1B shows a non-limiting exemplary digital microfluidics chip, compression sealed to the NIMS array. FIG. 1C shows the stack for holding the layers together. In FIG. 1C, layer i is a 3D printed top; layer ii is a PDMS mounting layer for interfacing fluidics to microfluidics; layer iii is a non-limiting exemplary chip containing the electrodes, dielectric and fluidics; layer iv is a non-limiting exemplary NIMS chip; and layer v is a non-limiting bottom piece with a dropbot adapter.

FIG. 3A is a non-limiting exemplary photograph of a conventional NIMS chip. FIG. 3B is a non-limiting exemplary photograph of patterned array of 640 μNIMS pads on silicon wafer with PDMS protective gasket partially peeled away. FIG. 3C is a non-limiting exemplary schematic illustration showing analytes sorbing onto NIMS pad from droplet. FIG. 3D shows a non-limiting exemplary structure, spectra and mass spectral image of dextromethorphan (272 m/z) adsorbed onto surface of μNIMS pads.

FIG. 4A shows the chemical structure of 1,4-b-D-cellotetraose-probe (G4) substrate and mass spectra of G4 substrate 1516 m/z (H+). FIG. 4B shows the chemical structure of cellotriose-probe (G3) product, mass spectra of G3 product 1354 m/z (H+). FIG. 4C shows the chemical structure of cellobiose-probe (G2) product, mass spectra of G2 product 1354 m/z (H+). FIG. 4D shows chemical structure of glucose-probe (G1) product, and mass spectra of G1 product 1354 m/z (H+).

FIG. 5A is a non-limiting exemplary plot showing enzyme kinetics of CelE-CBM3a as visualized by μNIMS. 1,4-b-D-cellotetraose-probe (G4) substrate, to cellotriose-probe (G3) product, cellobiose-probe (G2) and glucose-probe (G1) as visualized using NIMS array from μNIMS, A. time series analysis of CelE in phosphate buffer solution (pH=6.0). FIG. 5B is a non-limiting exemplary plot showing time series analysis of CelE in acetate buffer (pH=5.0). If error bars are not present, then no deviation was observed.

DETAILED DESCRIPTION

Figure 1A:
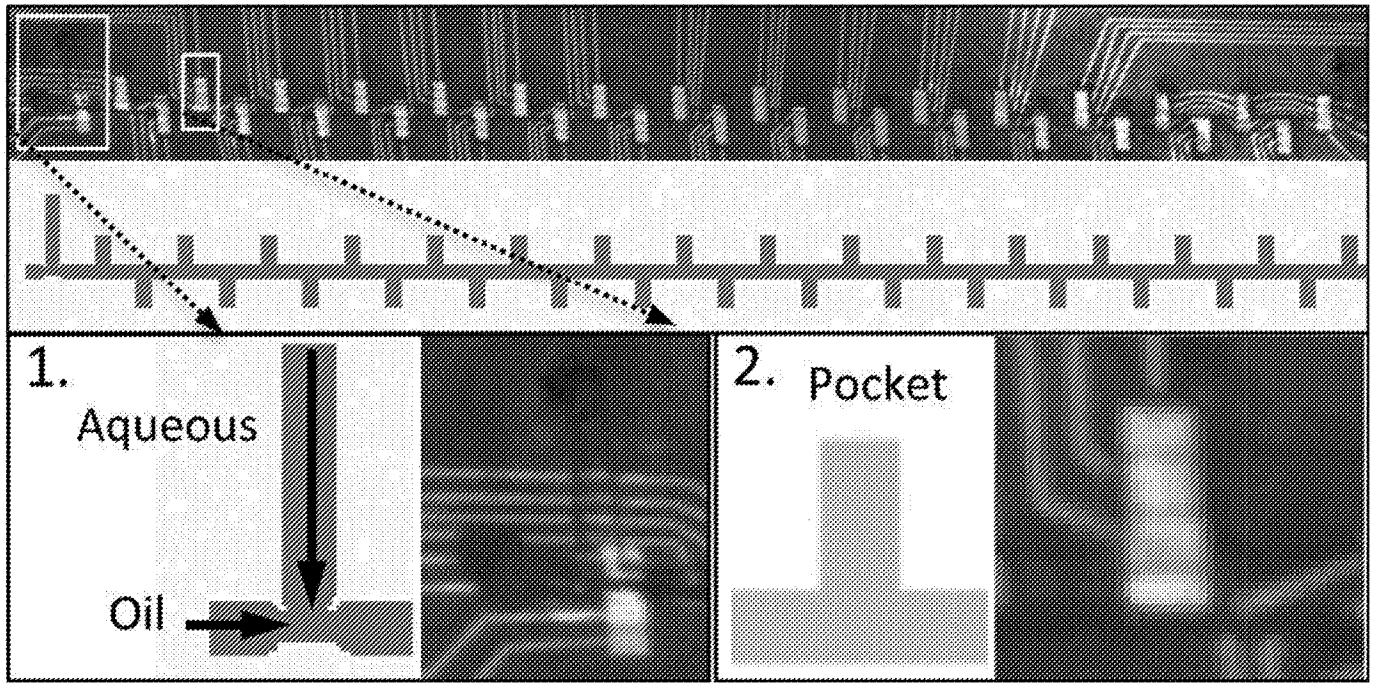
FIGS. 1A-1C show a non-limiting exemplary μNIMS assembly, operation, and workflow.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein and made part of the disclosure herein.

Biological assays often require expensive reagents and tedious manipulations. These shortcomings can be overcome using digitally operated microfluidic devices that require reduced sample volumes to automate assays. One particular challenge is integrating bioassays with mass spectrometry based analysis. Disclosed herein are systems, methods, and devices for μNIMS. μNIMS can be a highly sensitive and high throughput technique that integrates droplet microfluidics with nanostructure-initiator mass spectrometry (NIMS). Enzyme reactions can be carried out in droplets that can be arrayed on discrete NIMS elements at defined time intervals for subsequent mass spectrometry analysis, enabling time resolved enzyme activity assay.

Enzymes can be engineered to modify their function or catalytic efficiency to increase product yields significantly through the use of directed evolution or rational protein design. Mass spectrometry is a label-free detection technique for measuring biochemical activity and has for some become the method of choice for high throughput assays. However, the traditional mass spectrometry approaches for screening samples are slow and require large sample volumes often making them cost prohibitive for high throughput screening efforts.

Programmable control of digital microfluidic functions can have the potential to drastically increase both the scale and quality of enzymatic functional screening. The throughput of droplet microfluidics and versatility of digital microfluidics can be combined to accomplish the throughput and control of both in droplet-to-digital (D2D) microfluidics. Microfluidic systems may have limited scope of use because analytical detection can be limited to optical methods, which may inhibit the ability to be adapted for multiple applications. This may be a function of design, where systems have been built to accomplish a goal using a strategy to overcome necessary technological hurdles, while also considering fabrication costs.

There is great value in a system, which utilizes programmable architecture to be adaptable to a variety of different experimental applications. In D2D, droplets can be generated using a droplet generator and electrodes can allow programmatic control of fluidic movement and electrode actuation to change the outcome of individual experiments. To build on this interface, variable program microfluidics, droplet transportation protocol rules similar to computational communication rules such as Transmission Control Protocol/Internet Protocol (TCP/IP) can be used for establishing a technical standard for interfacing physically separated microfluidic functions. These rules can define syntax, semantics and synchronization of communication and possible error recovery methods when integrating multiple devices with D2D.

Nanostructure-initiator mass spectrometry (NIMS) can directly measure the substrates and products of enzymatic reactions and can be broadly applicable to many molecule classes including metabolites, drugs and peptides. NIMS can adsorb biomolecules onto a surface by utilizing acoustic printing for sample deposition. Theoretic maximum density for these reactions can be approximately 14,884 samples per 5 $cm^2$ chip when using acoustic printing. The total reaction volumes required for acoustic printing can be 20 microliters per reaction.

NIMS can be an easier, more high-throughput way of laser desorption mass spectrometry than traditional matrix assisted laser desorption and ionization (MALDI). The methods, compositions, and systems disclosed herein can interface microfluidics, which can be based on silicon wafer technology, with mass spectrometry (microMS). MicroMS can be used for identification and quantification of small molecules such as metabolites, drugs, and peptides, and to characterize enzymatic variants. Functional genomics methods can be used for the expression of large number of enzymatic variants and mutants in a culture independent manner.

Nanostructure-initiator mass spectrometry (NIMS) is a laser desorption/ionization approach that offers very high throughput and requires very small amounts of samples. It directly measures the substrates and products of enzymatic reactions and is broadly applicable to many molecule classes including metabolites, drugs and peptides, and has been developed to rapidly analyze enzyme activities to support the development of improved biomass degrading enzymes. NIMS uses liquid (initiator) coated silicon nanostructures to generate gas phase ions from surface adsorbed molecules upon laser irradiation. Microfabrication of NIMS can allow biochemical reactions as low as 1 nl of deposited sample. The use of acoustic printing with NIMS has shown much promise for large-scale screening efforts, in vitro expression and analysis of enzyme activities. As the dead volume required to print from 384-well plates is approximately 20 it can be expensive to perform large-scale screening using NIMS. Since NIMS is fabricated from silicon based material, it is well suited for integration with microfluidics, offering the potential to conduct assays in picoliter droplets which greatly reduces cost and increases throughput potential.

The Nimzyme technology based upon NIMS has been developed. The Nimzyme technology can be used to screening enzymatic mutants without requiring significant modification for adaptation to other enzyme classes. The Nimzyme technology can use perfluorous tagged substrates coupled with rapid chip-based analysis for cellulose degrading functional screening, and can be more broadly applied. In NIMS, tagged substrates can adsorb onto the mass spectrometry surface and interfering molecules and proteins can be washed away, allowing NIMS sensitivity to attomolar ($10^{-18}$) detection. NIMS can be utilized to assay large numbers of cellulose degrading enzymes using a rapid chip based analysis using acoustic printing. However, NIMS and Nimzyme require human sample preparation which can limit throughput.

There are many examples of integrated microfluidic/mass spectrometry, from electrospray ionization (ESI) to matrix assisted laser desorption ionization (MALDI). Two such approaches show integration of MALDI with microfluidics can be useful for both peptide, and protein identification. Programmable control of digital microfluidic functions can enable droplet operations, which can be improvements for enzymatic functional screening, because of electronic timing and control. Typical NIMS assays require a washing step to remove cell debris which often interferes with mass spectrometry analysis, using microfluidics could allow automated sample processing using electro-wetting on dielectric (EWOD), to automate this process. In addition, integrated digital droplet devices have the potential to effectively array droplets onto the NIMS surface, adsorbing the substrates and products, and then removing the droplet to minimize ion suppression from salts, etc. The systems and methods disclosed herein can utilize combined droplet and digital microfluidics for programming diverse biochemical operations including genomic assembly, transformation and culture.

Programmable microfluidic functions can be run sequentially and in loops to replace human preparation similar to robotic systems. In digital microfluidics, automated cycles can execute sequences of three operations: 1) merging, 2) mixing and 3) splitting droplets, to be executed sequentially or in parallel. The diversity of metabolites detectable by NIMS makes it suitable for integration with programmable microfluidics. Disclosed herein are devices and methods utilizing a droplet-to-digital interface with pressure driven transport of samples onto a digital microfluidic device where droplets can be formed, manipulated and placed onto a defined array for assay using NIMS.

The methods and systems disclosed herein utilize microfluidics and mass spectrometry such as NIMS (microNTMS) in tandem for studying enzyme kinetics, screening of enzyme mutants, and characterization of unknown enzyme functions. The chip setup can be similar to a memory array where droplets of enzyme cocktail, instead of bits, can be stored at a defined location. These methods and systems can be used for droplet generation and placement of enzymatic cocktails over addressable microMS pads for screening of enzyme kinetics. Technical standards for digital metabolic monitoring can be created based on the methods and systems disclosed herein. While the droplets can be transiently located onto the NIMS pad, the substrate and product probes can stick indefinitely, which can allow the NIMS array to be removed from the microfluidic system and placed on to a MALDI plate and imaged using mass spectrometry.

In some embodiments, the methods and systems disclosed herein can be advantageously used to process enzymatic cocktails into appropriately sized droplets, parse those droplets into defined locations. These methods and systems may be interfaced with upstream microfluidic devices, thus allowing high resolution mass spectrometry to be used to visualize over 72,000 metabolites in the METLIN database. Thus, these methods and systems can be used for evaluating enzymatic systems and screening, enzyme variants, and biofluid analysis, and quantifying small molecule biomarkers Other advantages of the methods and systems disclosed herein can include adaptability to a wide variety of experimental conditions and sample compositions for studying many different enzymes through the analysis of their metabolites. These methods and systems can have the advantages of low cost execution of enzymatic reactions and high throughput for increasing enzyme kinetics in mutational screening and enzyme characterization. These methods and systems can be used for time series analysis to determine enzyme kinetics from the turnover of substrate to product over time.

With the methods and systems disclosed herein, sample preparation can be automated directly from source by combining several functions which reduces reagent consumption. It can achieve this using droplet/digital microfluidics to encapsulate samples within droplets. The sequence and speed of transport of encapsulated droplets can be controlled using electrodes and pressure driven flow synonymous with electrical transport of information. Digital microfluidic electronics can be used to track a large variety of enzymes and substrates and mix them at controlled time intervals allowing the characterization of said enzyme kinetic through mass spectrometry quantitation of substrate. A droplet, similar to digital information, can be controlled and automated.

In some embodiments, the methods and systems disclosed herein can overcome the traditional incompatibilities between droplet and digital microfluidics and mass spectrometry based detection. These methods and systems can be used for, for example, screening enzymes in cellulose deconstruction. These methods and systems can screen large numbers of mutants, for example 640, at small volumes using microfluidics. These methods and systems can be used in conjunction with benchtop experiments.

Disclosed herein are systems, methods, and devices which integrate microfluidics with NIMS in a platform (referred to herein as μNIMS or microNIMS). μNIMS can enable digital control of enzymatic time course for cellulose-degrading enzyme using NIMS as a biosensor. The chip moves droplets onto a NIMS surface, incubates and then removes after a defined period of time. Probe sorbed to the NIMS surface allow mass spectral kinetic characterization of cellulose degrading enzymes. This technology is appealing because it has programmable time resolution, scalable density, and can be more broadly applied.

Definitions

Unless defined otherwise, technical and scientific terms used herein have the same meaning as commonly understood by one of ordinary skill in the art to which the present disclosure belongs. See, e.g. Singleton et al., Dictionary of Microbiology and Molecular Biology 2nd ed., J. Wiley & Sons (New York, N.Y. 1994); Sambrook et al., Molecular Cloning, A Laboratory Manual, Cold Springs Harbor Press (Cold Springs Harbor, N.Y. 1989).

Disclosed herein are devices for detecting compounds in microfluidic droplets using mass spectrometry. In some embodiments, the device comprises: a microfluidic device; and a mass spectrometry plate, wherein the mass spectrometry plate is reversibly sealed to the microfluidic device. The microfluidic device can comprise a droplet-to-digital microfluidic device. In some embodiments, the droplet-to-digital microfluidic device comprises: a glass layer; an electrode layer; a dielectric layer; and a microfluidics layer. The glass layer can be on a first side of the electrode layer, and the dielectric layer can be on a second side of the electrode layer. The electrode layer can be on a first side of the dielectric layer, and the microfluidics layer can on a second side of the dielectric layer. The dielectric layer can be on a first side of the microfluidics layer, and the mass spectrometry plate can be on a second side of the microfluidics layer.

Disclosed herein are methods for detecting compounds in droplets using mass spectrometry. In some embodiments, the method comprises: providing a microfluidics-mass spectrometry (microMS) device, comprising: a droplet-to-digital microfluidic device, wherein the droplet-to-digital microfluidic device comprises: a glass layer, wherein the glass layer comprises fluidic access ports; an electrode layer, wherein the electrode layer comprises chrome electrodes etched onto one side of the glass layer; a dielectric layer, wherein the dielectric layer is configured for electrowetting; and a microfluidics layer, wherein the microfluidics layer comprises channels, pockets, and a droplet generator, wherein the pockets are connected to the channels; a mass spectrometry plate, wherein the mass spectrometry plate is reversibly sealed to the microfluidic device; and producing droplets comprising one or more compounds using the droplet generator of the microMS device; and generating mass spectra for the droplets to detect one or more compounds in the droplets.

Microfluidics-NIMS Devices

The programmable architecture of device allows μNIMS to place droplets onto the NIMS surface and remove them at different times for analysis of enzyme kinetics. This ability to deposit sample and subsequently remove the droplets enables the device to take advantage of the fluorous phase interactions between the NIMS surface and derivatized substrates and products. A washing step can be implemented for applications such as analysis of enzyme activities from soils.

In some embodiment, the device operates via electro wetting on dielectric (EWOD), as compared to dielectrophoresis (DEP). Aqueous droplets can be drawn into and out of the NIMS pocket by their attraction to the charge, which accumulates over the electrodes. Impedance detection can be used to detect actuation failure. In some embodiments, the level of droplet control automation can be beyond the abilities of the dropbot and microdrop graphical user interface (GUI). In some embodiments, integration with syringe pumps can enable mitigating contingency. Dropbot GUI may enable automated corrective measures to be performed when actuation fails. For example, failure can be attributed to fabrication imperfection or dust contamination in dielectric layer. In some embodiments, NIMS compatible surfactants can be used. Non-compatible surfactants may interfere with biomolecule characterization by mass spectrometry, as a result of their often efficient desorption/ionization, relatively high concentrations, and the fact that they are often heterogeneous mixtures resulting in multiple ions.

Disclosed herein are devices for detecting compounds in microfluidic droplets using mass spectrometry. In some embodiments, the device comprises: a microfluidic device; and a mass spectrometry plate, wherein the mass spectrometry plate is reversibly sealed to the microfluidic device. The microfluidic device can comprise a droplet-to-digital microfluidic device. The device can be used to array large quantities of enzyme and substrate onto a defined grid to allow enzymatic characterization.

In some embodiments, the droplet-to-digital microfluidic device comprises: a glass layer; an electrode layer; a dielectric layer; and a microfluidics layer. The glass layer can be on a first side of the electrode layer, and the dielectric layer can be on a second side of the electrode layer. The electrode layer can be on a first side of the dielectric layer, and the microfluidics layer can on a second side of the dielectric layer. The dielectric layer can be on a first side of the microfluidics layer, and the mass spectrometry plate can be on a second side of the microfluidics layer.

In some embodiments, the electrode layer comprises electrodes etched onto one side of the glass layer. The electrodes can comprise chrome electrodes. The electrode layer can be configured to manipulate droplets in the microfluidics layer. In some embodiments, the glass layer comprises fluidic access ports. Droplets can be manipulated by, for example, splitting and mixing with other droplets, moving droplets into pockets or target areas of the micropatterned mass spectrometry plate. In some embodiments, the dielectric layer can be configured for electrowetting.

In some embodiments, the microfluidics layer comprises channels. Depths of some of the channels can vary from 1-1000 μm. In some embodiments, depths of some of the channels can be, or be about, 1, 2, 3, 4, 5, 6, 7, 8, 9, 10, 20, 30, 40, 50, 60, 70, 80, 90, 100, 200, 300, 400, 500, 600, 700, 800, 900, 1000 μm, or a number or a range between any two of these values. In some embodiments, depths of some of the channels can be at least, or at most, 1, 2, 3, 4, 5, 6, 7, 8, 9, 10, 20, 30, 40, 50, 60, 70, 80, 90, 100, 200, 300, 400, 500, 600, 700, 800, 900, or 1000 μm. Widths of some of the channels can vary from 1-1000 μm. In some embodiments, widths of some of the channels can be, or be about, 1, 2, 3, 4, 5, 6, 7, 8, 9, 10, 20, 30, 40, 50, 60, 70, 80, 90, 100, 200, 300, 400, 500, 600, 700, 800, 900, 1000 μm, or a number or a range between any two of these values. In some embodiments, widths of some of the channels can be at least, or at most, 1, 2, 3, 4, 5, 6, 7, 8, 9, 10, 20, 30, 40, 50, 60, 70, 80, 90, 100, 200, 300, 400, 500, 600, 700, 800, 900, or 1000 μm.

In some embodiments, the microfluidics layer comprises one or more droplet generators, for example T-junction droplet generators. The droplet generators can be connected to the channels of the microfluidics layer. The number of droplet generators can vary. In some embodiments, the number of droplet generators can be, or be about, 1, 2, 3, 4, 5, 6, 7, 8, 9, 10, 20, 30, 40, 50, 60, 70, 80, 90, 100, or a number or a range between any two of these values. In some embodiments, the number of droplet generators can be at least, or at most, 1, 2, 3, 4, 5, 6, 7, 8, 9, 10, 20, 30, 40, 50, 60, 70, 80, 90, or 100.

In some embodiments, the microfluidics layer can comprise pockets connected to the channels of the microfluidics layer. The pockets can contain droplets generated by the microfluidics layer and manipulated by the electrode layer. The number of pockets can vary. In some embodiments, the number of pockets can be, or be about, 1, 2, 3, 4, 5, 6, 7, 8, 9, 10, 20, 30, 40, 50, 60, 70, 80, 90, 100, 200, 300, 400, 500, 600, 700, 800, 900, 1000, 2000, 3000, 4000, 5000, 6000, 7000, 8000, 9000, 10000 or a number or a range between any two of these values. In some embodiments, the number of pockets can be at least, or at most, 1, 2, 3, 4, 5, 6, 7, 8, 9, 10, 20, 30, 40, 50, 60, 70, 80, 90, 100, 200, 300, 400, 500, 600, 700, 800, 900, 1000, 2000, 3000, 4000, 5000, 6000, 7000, 8000, 9000, or 10000.

Pocket volumes can vary. In some embodiments, the volume of one pocket or the volume of at least one pocket can be, or be about, 1, 2, 3, 4, 5, 6, 7, 8, 9, 10, 20, 30, 40, 50, 60, 70, 80, 90, 100, 200, 300, 400, 500, 600, 700, 800, 900, 1000, or a number or a range between any two of these values, picoliters. In some embodiments, the volume of one pocket or the volume of at least one pocket can be at least, or at most, 1, 2, 3, 4, 5, 6, 7, 8, 9, 10, 20, 30, 40, 50, 60, 70, 80, 90, 100, 200, 300, 400, 500, 600, 700, 800, 900, or 1000, picoliters. In some embodiments, the volume of a pocket or the volume of at least one pocket can be, or be about, 1, 2, 3, 4, 5, 6, 7, 8, 9, 10, 20, 30, 40, 50, 60, 70, 80, 90, 100, 200, 300, 400, 500, 600, 700, 800, 900, 1000, or a number or a range between any two of these values, nanoliters. In some embodiments, the volume of a pocket or the volume of at least one pocket can be at least, or at most, 1, 2, 3, 4, 5, 6, 7, 8, 9, 10, 20, 30, 40, 50, 60, 70, 80, 90, 100, 200, 300, 400, 500, 600, 700, 800, 900, or 1000, nanoliters. In some embodiments, the volume of a pocket or the volume of at least one pocket can be, or be about, 1, 2, 3, 4, 5, 6, 7, 8, 9, 10, or a number or a range between any two of these values, microliters. In some embodiments, the volume of a pocket can be at least, or at most, 1, 2, 3, 4, 5, 6, 7, 8, 9, or 10, microliters.

In some embodiments, the mass spectrometry plate can be fabricated using Reactive Ion Etching. In some embodiments, the mass spectrometry plate can be reversibly sealed to the microfluidic device with a rubbery seal. The mass spectrometry plate can be reversibly sealed at a predetermined pressure. The reversible seal can allow individual droplets generated by the device to be placed at defined locations on the mass spectrometry plate, for example a mass spectrometry chip. The mass spectrometry plate can then be detached from the microfluidics device and scanned using a mass spectrometer. This coordinates of this plate can be logged into a mass spectrometer and ionized using the coordinates of the targeted grid to be selectively ionized.

The material of the rubbery seal can be different in different implementations. In some embodiments, the material of the rubbery seal can be, or can comprise, nitrile rubbers in the form of butadiene-acrylonitrile co- or terpolymers, partially or fully hydrogenated nitrile rubbers in the form of hydrogenated butadiene-acrylonitrile co- or terpolymers, carboxylated nitrile rubbers, partially or fully hydrogenated carboxylated nitrile rubbers, ethylene-vinyl acetate copolymers, ethylene-propylene-diene copolymers, styrene-butadiene copolymers, polychloroprene, polybutadiene, acrylate rubber, fluororubber, isobutylene-isoprene copolymers (e.g., with isoprene contents of from 0.5 to 0% by weight), brominated isobutylene-isoprene copolymers (e.g., with bromine contents of from 0.1 to 10% by weight, chlorinated isobutylene-isoprene copolymers (e.g., with chlorine contents of from 0.1 to 10% by weight), butadiene-C-4-alkyl acrylate copolymers, polyisoprene, carboxylated styrene-butadiene copolymers ethylene-acrylate copolymers, epichlorohydrin rubbers, silicone rubbers, polyester urethane polymers, EU polyether urethane polymers, epoxidized natural rubber, or any combination thereof.

In some embodiments, the predetermined pressure can be, or be about, 1, 2, 3, 4, 5, 6, 7, 8, 9, 10 MPa, or a number or a range between any two of these values. In some embodiments, the predetermined pressure can be at least, or at most, 1, 2, 3, 4, 5, 6, 7, 8, 9, or 10 MPa. The mass spectrometry plate can be reversibly sealed at a pressure higher than an inner pressure of the microfluidics device. The inner pressure of the microfluidics device can vary. In some embodiments, the inner pressure of the microfluidics device can be 1, 2, 3, 4, 5, 6, 7, 8, 9, 10 MPa, or a number or a range between any two of these values. In some embodiments, the inner pressure of the microfluidics device can be at least, or at most, 1, 2, 3, 4, 5, 6, 7, 8, 9, or 10 MPa.

In some embodiments, the mass spectrometry plate comprises micropatterns. The micropatterns can be configured for correct alignment of the mass spectrometry plate with the microfluidics device and allow targeted droplet deposition. The mass spectrometry plate can comprise a number of mass spectrometry pads. In some embodiments, the number of mass spectrometry pads can be, or be about, 1, 2, 3, 4, 5, 6, 7, 8, 9, 10, 20, 30, 40, 50, 60, 70, 80, 90, 100, 200, 300, 400, 500, 600, 700, 800, 900, 1000, 2000, 3000, 4000, 5000, 6000, 7000, 8000, 9000, 10000 or a number or a range between any two of these values. In some embodiments, the number of mass spectrometry pads can be at least, or at most, 1, 2, 3, 4, 5, 6, 7, 8, 9, 10, 20, 30, 40, 50, 60, 70, 80, 90, 100, 200, 300, 400, 500, 600, 700, 800, 900, 1000, 2000, 3000, 4000, 5000, 6000, 7000, 8000, 9000, or 10000.

Combinatorial Screening Space

The methods, compositions, and systems disclosed herein can be used to screen a large combinatorial space of reaction conditions for enzyme optimization, pathway optimization, investigation of cell metabolism, and drug screening. The number of parameters screened can vary. For example, the number of parameters screened can be, or be about, 1, 2, 3, 4, 5, 6, 7, 8, 9, 10, 20, 30, 40, 50, 60, 70, 80, 90, 100, 200, 300, 400, 500, 600, 700, 800, 900, 1000, or a number or a range between any two of these values. As another example, the number of parameters screened can be at least, or at most, 1, 2, 3, 4, 5, 6, 7, 8, 9, 10, 20, 30, 40, 50, 60, 70, 80, 90, 100, 200, 300, 400, 500, 600, 700, 800, 900, or 1000. The number of reaction conditions screened can vary. For example, the number of reaction conditions screened can be, or be about, 1, 2, 3, 4, 5, 6, 7, 8, 9, 10, 20, 30, 40, 50, 60, 70, 80, 90, 100, 200, 300, 400, 500, 600, 700, 800, 900, 1000, $10^4$, $10^5$, $10^6$, $10^7$, $10^8$, $10^9$, or a number or a range between any two of these values. For example, the number of reaction conditions screened can be at least, or at most, 1, 2, 3, 4, 5, 6, 7, 8, 9, 10, 20, 30, 40, 50, 60, 70, 80, 90, 100, 200, 300, 400, 500, 600, 700, 800, 900, 1000, $10^4$, $10^5$, $10^6$, $10^7$, $10^8$, or $10^9$.

Droplet Volume

Disclosed herein are systems, methods, and devices for manipulation of droplets. In some embodiments, the device can be used for manipulation of droplets (e.g., droplets each with a volume of 150 nl) with subsequent deposition onto the NIMS surface, achieving a significant reagent reduction, compared with a 20 μl dead volume for other methods. This device can be interface with a number of NIMS pads simultaneously (e.g., 31 pads) and can be physically re-aligned to the next position on the array (e.g., containing 640 pads total). Using the device each NIMS array can be used for rapid kinetic characterization of different enzymes or conditions (e.g., 20 different enzymes or conditions). In some embodiments, the device can be used for a larger number of assays. For example, 620 individual assays can be performed at 1 pad per enzyme. Depending on experimental demands, the number of replicates can be modified. For example, the number reaction conditions investigated can be increased. Alternatively, or additionally, the time resolution can be increased.

The methods, compositions, and systems disclosed herein can be used to incubate an enzyme in one or more droplets. Droplet volumes can vary. In some embodiments, the volume of one droplet or the volume of at least one droplet can be, or be about, 1, 2, 3, 4, 5, 6, 7, 8, 9, 10, 20, 30, 40, 50, 60, 70, 80, 90, 100, 200, 300, 400, 500, 600, 700, 800, 900, 1000, or a number or a range between any two of these values, picoliters. In some embodiments, the volume of one droplet or the volume of at least one droplet can be at least, or at most, 1, 2, 3, 4, 5, 6, 7, 8, 9, 10, 20, 30, 40, 50, 60, 70, 80, 90, 100, 200, 300, 400, 500, 600, 700, 800, 900, or 1000, picoliters. In some embodiments, the volume of a droplet or the volume of at least one droplet can be, or be about, 1, 2, 3, 4, 5, 6, 7, 8, 9, 10, 20, 30, 40, 50, 60, 70, 80, 90, 100, 200, 300, 400, 500, 600, 700, 800, 900, 1000, or a number or a range between any two of these values, nanoliters. In some embodiments, the volume of a droplet or the volume of at least one droplet can be at least, or at most, 1, 2, 3, 4, 5, 6, 7, 8, 9, 10, 20, 30, 40, 50, 60, 70, 80, 90, 100, 200, 300, 400, 500, 600, 700, 800, 900, or 1000, nanoliters. In some embodiments, the volume of a droplet or the volume of at least one droplet can be, or be about, 1, 2, 3, 4, 5, 6, 7, 8, 9, 10, or a number or a range between any two of these values, microliters. In some embodiments, the volume of a droplet can be at least, or at most, 1, 2, 3, 4, 5, 6, 7, 8, 9, or 10, microliters.

In some embodiments, device design allowed droplets to be maintained at ±10% standard deviation in size except initially during flow where droplets tended to be larger. While droplet reproducibility may be desirable, the device can be based on fractional conversion, which can be a very effective approach for controlling experimental variation in NIMS enzyme activity assays. For example, the fractional conversion of G4 into G1 would be [G1]/([G4]+[G3]+[G2]+[G1]). This can be considered an internal normalization that makes these assays less sensitive to variations in droplet volumes and other sources of variations than assays focused on direct measurements of concentration.

Mass Spectrometry

The methods, compositions, and systems disclosed herein can utilize mass spectrometry to generate a mass spectrum for each mixture after incubating an enzyme with a substrate. In some embodiments, the mass spectrum can be generated using soft ionization mass spectrometry (MS), such as matrix associated laser desorption ionization (MALDI-MS). In some embodiments, the mass spectrum can be generated using electrospray ionization MS (ESI-MS), liquid chromatography ESI-MS, nanostructure-initiator MS, fast atom bombardment MS, chemical ionization MS, atmospheric-pressure chemical ionization MS, matrix-assisted laser desorption/ionization MS, or any combination thereof.

Substrates

The methods, compositions, and systems disclosed herein can utilize different substrates to produce varying reaction products. In some embodiments, a substrate can be 6-mercaptopurine, cellobiose, cellotetraose, xylotetraose, isoprimeverose, β-D-gentiobiose, xyloglucan and mannotriose, or any combination thereof. In some embodiments, the one or more substrate can be agarose, aminic acid, starch, oligosaccharide, polysaccharide, cellulose, ceramide, chitine, chitosan, dextrose, dextrins, fructose, fucoidan, fucose, furanoside, galactoside, glucan, glucopyranoside, glucoside, glucuronic acid, glucuronoside, glycose, glycoside, glycosaminoglycan, hexaoside, inulin, lactose, levanose, lipopolysaccharide, mannose, maltoside, maltotrioside, mannose, octulosonate, oligosaccharide, pectate, pectin, peptide, polygalacturonide, polynucleotides, pullulan, rhamnoside, xylan, or any combination thereof.

Substrates can differ from one another. In some embodiments, substrates can differ from one another by at least one functional group. The at least one functional group can be alkyl, alkenyl, alkynyl, phenyl, benzyl, halo, fluoro, chloro, bromo, iodo, hydroxyl, carbonyl, aldehyde, haloformyl, carbonate ester, carboxylate, carboxyl, ester, methoxy, hydroperoxy, peroxy, ether, hemiacetal, hemiketal, acetal, ketal, acetal, orthoester, methylenedioxy, orthocarbonate ester, carboxamide, primary amine, secondary amine, tertiary amine, 4° ammonium, primary ketamine, secondary ketamine, primary aldimine, secondary aldimine, imide, azide, azo, diimide, cyanate, isocyanate, nitrate, nitrile, isonitrile, nitrosooxy, nitro, nitroso, pyridyl, sulfhydryl, sulfide, disulfide, sulfinyl, sulfonyl, sulfino, sulfo, thiocyanate, isothiocyanate, carbonothione, carbonothial, phosphino, phosphono, phosphate, phosphodiester, borono, boronate, borino, or borinate. In some embodiments, substrates can be lignin, cellulose, glucose, sugar, excrement, environmental contaminants (such as common environmental contaminants), switchgrass, or any combination thereof. In some embodiments, substrates can be any chemical compounds suitable for in vitro or in vivo transformation by enzymes, cells, or tissues. In some embodiments, substrates can be any chemical compounds that can by catalyzed by any catalysts, for example chemical catalysts or biological catalysts such as enzymes.

In some embodiments, substrates can differ from one another by or by about 1, 2, 3, 4, 5, 6, 7, 8, 9, 10, 20, 30, 40, 50, 60, 70, 80, 90, 100, 200, 300, 400, 500, 600, 700, 800, 900, 1000, or a number or a range between any two of these values, Daltons. In some embodiments, substrates can differ from one another by at least or by at most 1, 2, 3, 4, 5, 6, 7, 8, 9, 10, 20, 30, 40, 50, 60, 70, 80, 90, 100, 200, 300, 400, 500, 600, 700, 800, 900, 1000, or a number or a range between any two of these values, Daltons.

Substrates and reaction products can have different structures and molecular weights. A substrate and a reaction product can have different structures and molecular weights. In some embodiments, a substrate can differ from its corresponding reaction product by at least one functional group. In some embodiments, a substrate can differ from its corresponding reaction product by, or by about, 1, 2, 3, 4, 5, 6, 7, 8, 9, 10, 20, 30, 40, 50, 60, 70, 80, 90, 100, 200, 300, 400, 500, 600, 700, 800, 900, 1000, or a number or a range between any two of these values, Daltons. In some embodiments, a substrate can differ from its corresponding reaction product by at least, or at most, 1, 2, 3, 4, 5, 6, 7, 8, 9, 10, 20, 30, 40, 50, 60, 70, 80, 90, 100, 200, 300, 400, 500, 600, 700, 800, 900, 1000, or a number or a range between any two of these values, Daltons.

Enzymes

The methods, compositions, and systems disclosed herein can be used to test various enzymes. In some embodiments, the enzymes can be, or can include, Enzyme Commission (EC) 1 oxidoreductases (e.g., a dehydrogenase or an oxidase), EC 2 transferases (e.g., a transaminase or a kinase), EC 3 Hydrolases (e.g., a lipase, an amylase, or a peptidase), EC 4 Lyases (e.g., a decarboxylase), EC 5 Isomerases (e.g., an isomerase or a mutase), or EC 6 Ligases (e.g., a synthetase). In some embodiments, the enzymes can be, or can include, a methyltransferase or a glycoside hydrolase. In some embodiments, the enzymes can be, or can include, a agarase, a aminidase, a amylase, a biosidase, a carrageenase, a cellulase, a ceramidase, a chitinase, a chitosanase, a citrinase, a dextranase, a dextrinase, a fructosidase, a fucoidanase, a fucosidase, a furanosidase, a galactosidase, a galacturonase, a glucanase, a glucosidase, a glucuronidase, a glucuronosidase, a glycohydrolase, a glycosidase, a hexaosidase, a hydrolase, an iduronidase, a inosidase, an inulinase, a lactase, a levanase, a licheninase, a ligase, a lyase, a lysozyme, a maltosidase, a maltotriosidase, a mannobiosidase, a mannosidase, a muramidase, an octulosonase, an octulosonidase, a primeverosidase, a protease, a pullulanase, a rhamnosidase, a saminidase, a sialidase, a synthase, a transferase, a trehalase, a turonidase, a turonosidase, a xylanase, or a xylosidase.

The number of enzymes that can be tested (e.g., simultaneously tested, or in a multiplexing fashion) by the methods disclosed herein, or in the compositions and systems disclosed herein can vary. In some embodiments, the number of enzymes tested can be, or be about, 1, 2, 3, 4, 5, 6, 7, 8, 9, 10, 20, 30, 40, 50, 60, 70, 80, 90, 100, 200, 300, 400, 500, 600, 700, 800, 900, 1000, $10^4$, $10^5$, $10^6$, $10^7$, $10^8$, $10^9$, or a number or a range between any two of these values. In some embodiments, the number of enzymes tested can be at least, or at most, 1, 2, 3, 4, 5, 6, 7, 8, 9, 10, 20, 30, 40, 50, 60, 70, 80, 90, 100, 200, 300, 400, 500, 600, 700, 800, 900, 1000, $10^4$, $10^5$, $10^6$, $10^7$, $10^8$, or $10^9$.

EXAMPLES

Some aspects of the embodiments discussed above are disclosed in further detail in the following examples, which are not in any way intended to limit the scope of the present disclosure.

Unless otherwise specified, reagents used in the following examples were purchased from Sigma-Aldrich. Microfluidic device fabrication reagents and supplies included SU-8-5, SU-8-2075 and SU-8 Developer from Microchem (Newton, Mass.), gold and chromium-coated glass slides from Telic (Valencia, Calif.), indium tin oxide (ITO)-coated glass slides, and silicon wafers from Delta Technologies (Stillwater, Minn.), Aquapel from TCP Global (San Diego, Calif.), MF-321 positive photoresist developer from Rohm and Haas (Marlborough, Mass.), CR-4 chromium etchant from OM Group (Cleveland, Ohio), and AZ-300T photoresist stripper from AZ Electronic Materials (Somerville, N.J.). Sylgard 184 polydimethylsiloxane (PDMS) was purchased from Dow Corning (Midland, Mich.). For photopatternable PDMS benzophenone and mixed xylenes were purchased from Sigma. For silanization of master molds Trichloro(1H, 1H,2H-perfluorooctyl)silane (TPS) was used.

Example 1

Fabrication of Microfluidic Devices

This example demonstrates fabrication of microfluidic devices with dielectric coating, electrodes, and channels on glass slides using transparent photomasks.

Microfluidic devices were fabricated using a transparent photomask printed at CAD/Art Services Inc. (Bandon, Oreg.). Digital microfluidic electrodes and pads were patterned using photolithography and etching. Briefly, chrome Telic wafers pre-coated with AZ1500 positive resist were exposed to UV for 15 s (16 mW per $cm^2$) using an OAI Series 200 aligner (San Jose, Calif.) and were developed by immersing in MF-321 for ~1 min and rinsed with deionized water ($diH_2O$). The slide was then hard baked for 1 min at 120° C. using a hotplate. Chrome was etched by immersing the slide with resist in CR-4 for 5 min and with gentle agitation. The device was then rinsed with $diH_2O$ and immersed in AZ 300T stripper for 5 min to remove photoresist. The slide was again rinsed with $diH_2O$.

To prepare for dielectric coating, the slide (with electrodes) was soaked in acetone for 5 min with gentle agitation, rinsed with isopropanol (IPA) and soaked in $diH_2O$ for 5 min with gentle agitation, then dried with $N_2$ gas. Slides were then placed onto a hotplate at 120° C. for 10 min for post baking. The slide was then plasma treated for 5 min using 20% $O_2$ and RF power of 20 W (Brand) and subsequently coated with 5 μm layer dielectric using SU-8-5 following Microchem protocol.

For channel layer a master mold was constructed using SU-8-2075 with a height of 140 um. Spin speeds, soft and hard bakes, and development times were per Microchem's protocol. After development these were rinsed and dried with IPA and $H_2O$. These molds were then placed into vacuum desiccator with 200 μl of TPS and let sit overnight for silanization then hard baked for 15 min at 120° C.

To form channels onto electrodes and dielectric layer the master mold was placed into a vacuum desiccator and 5 ml of PDMS (20:1 PDMS to curing agent) was poured over the master mold and degassed under vacuum for 1 hour. Prior to molding, electrode/dielectric layer was plasma treated for 5 min using 20% $O_2$ and RF power of 20 W. To form channels, the master mold with PDMS was placed onto a hotplate at 100° C. for 1 hr with electrode/dielectric layer pressed against the master mold using a 1 kg aluminum block. Master mold was then removed and holes were drilled into the glass electrode layer using a 1/32" round bottom end mill (Other Machine Co., US) to allow fluidic access. The chip was then sealed against a glass slide and 100 μl of picoglide (Dolomite Microfluidics, UK) was pumped through the channel and let sit for 30 min. This was followed by a rinse with Novec HFE-7500 (3M, US).

Altogether, these data demonstrate fabrication of microfluidic devices.

Example 2

Fabrication of NIMS Arrays

This example demonstrates fabrication of NIMS arrays by coating a silicon wafer with a photopatternable PDMS.

NIMS arrays were fabricated by coating a silicon wafer with a photopatternable PDMS to selectively etch only small areas of the silicon wafer for subsequent analysis using NIMS. The PDMS mixture was prepared by mixing with the curing agent in a 10:1 ratio (m/m). The benzophenone was mixed with the PDMS to a final concentration of 3%, and degassed by centrifugation. The mixture was then spin coated onto a silicon wafer at 2500 rpm for 30 s and exposed to UV (<365 nm) for 10 min under the appropriate photomask. The photomask was position ~100 μm over the substrate for the duration of the exposure. For post exposure bake the substrate was placed in a vacuum oven on top of a piece of cardboard at 120° C. for 2.5 min. Afterward the substrate was developed in toluene for 10 s and immediately rinsed with IPA and $H_2O$.

A nitrogen gun with strong flow rate was applied to blow off any particle residues from the substrate's surface. It was then placed into the etching chamber of a PlasmaLab 100 etching tool (Oxford Instrument) to fabricate nanostructured μNIMS pads by inductively coupled plasma reactive ion etching (ICP-RIE) process. A plasma mixture of SF6 and $O_2$ at 30/20 gas ratio with 6 mTorr chamber pressure was used, and the powers of etching chamber and plasma generator chamber were fixed at 5 W and 1000 W, respectively. To balance etching depth and passivation layer formation, a steady cryogenic temperature, −80° C., was maintained during the etching process.

Altogether, these data demonstrate fabrication of NIMS arrays.

Example 3

MicroNIMS Chip Assembly

This example demonstrates assembly of a microNTMS device, an integrated NIMS/D2D device consisting of five layers: one NIMS chip layer and four microfluidics layers.

Figure 1B:
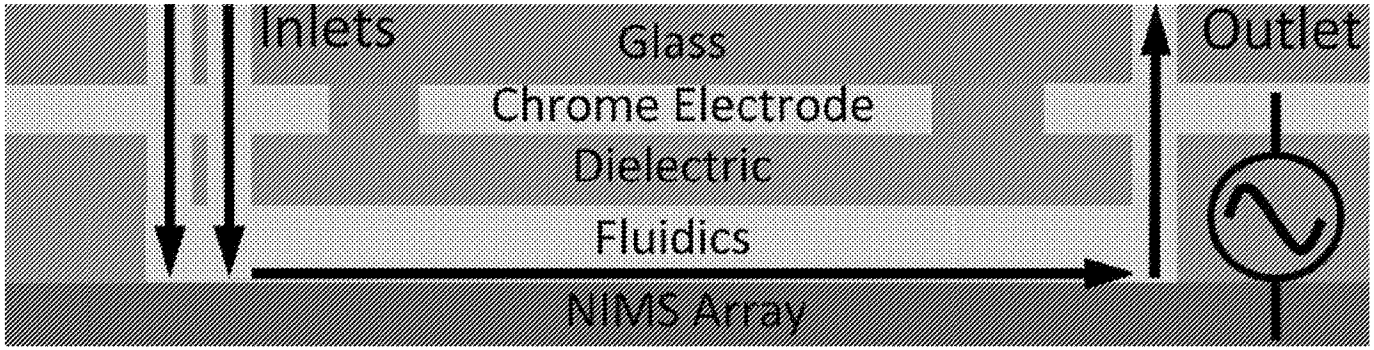
Figure 1C:
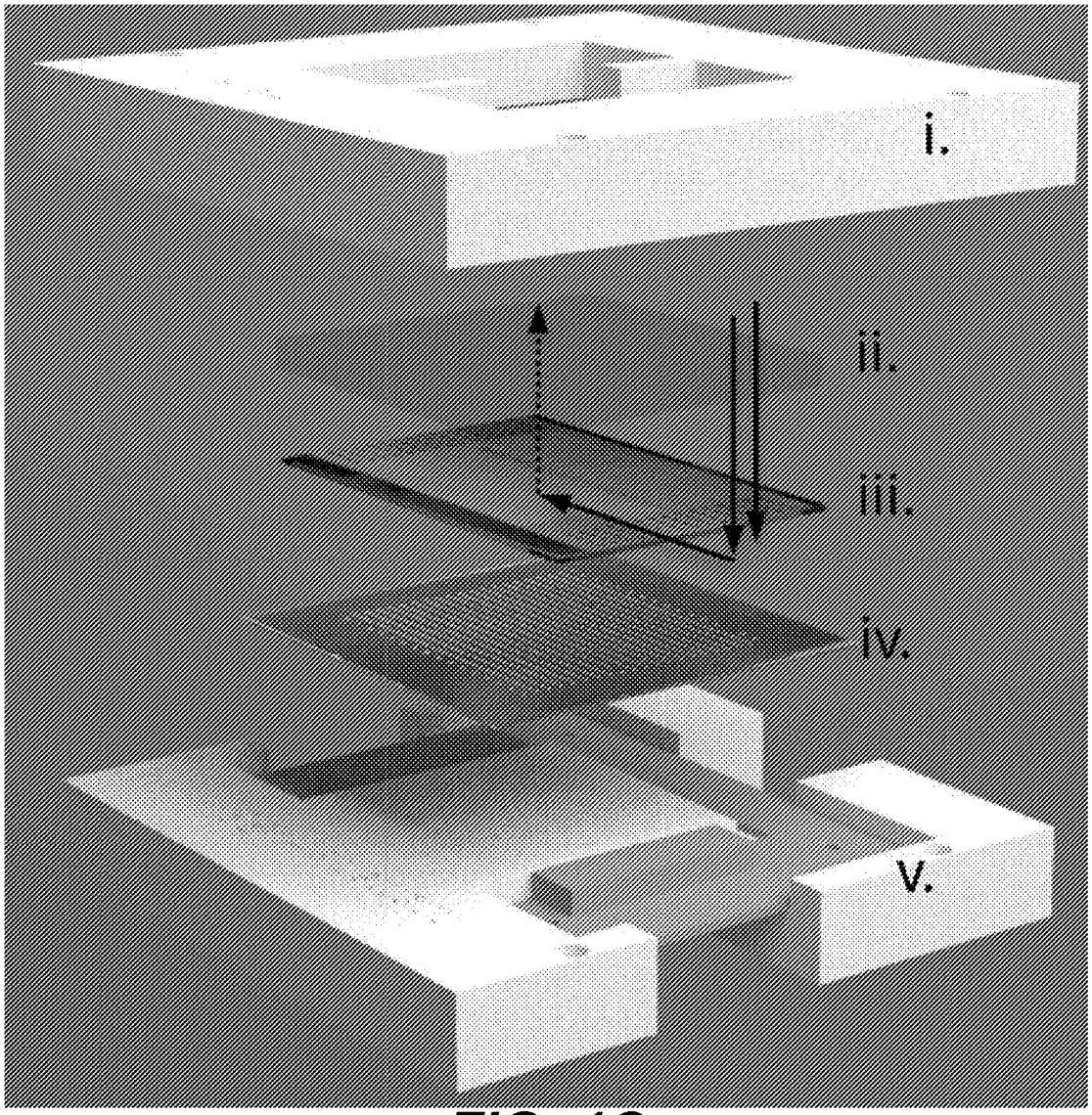

FIGS. 1A-1C show a non-limiting exemplary microMS assembly. FIG. 1A shows a non-limiting exemplary illustration of an electrode and fluidics design of a microfluidics chip (Layer iii in FIG. 1A). FIG. 1A panel i shows a non-limiting exemplary T-junction droplet generator. FIG. 1A panel ii shows a non-limiting exemplary microNIMS pocket. FIG. 1B shows the compression stack for holding the microfluidics device together with the MS chip, for example a NIMS chip. Layer i was a 3D printed top piece. Layer ii was a PDMS mounting layer for interfacing fluidics to microfluidics. Layer iii was a microfluidics chip containing the electrodes, dielectric and fluidics channel. Layer iv was a NIMS chip. Layer v was 3D printed bottom piece with integrated 120 pin Dropbot PCB. FIG. 1C shows structure of digital microfluidics chip, compression sealed to the bottom MS chip/ground plate.

The manifold for holding together the microNIMS system was designed using Blender (Blender.org) and 3D printed using polylactic acid (Ultimaker 2) at 215° C. extrusion temperature (FIG. 1C, layers i and v). The overall assembly had five layers (FIG. 1B), and the microfluidics portion of the assembly consisted of four separate layers (FIG. 1C). The pogo pin contact pads were compressed against the Dropbot PCB connector simultaneously, and the PDMS was compressed against the NIMS chip/ground plate to create a reversible fluidic seal. This allowed the NIMS array to be removed from the system and placed in the mass spectrometer once the experiment is completed.

The droplet-to-digital microfluidics chip consists of chrome electrodes over a central fluidics channel (FIG. 1B). The chip contains two basic functions, a t-junction for droplet generation (FIG. 1A, panel 1) and 31 arrayers for droplet actuation over μNIMS pads (FIG. 1A, panel 2). The chip layers facilitated droplet actuation where glass substrate, chrome electrodes, dielectric, and fluidics makes the top of the stack for interfacing with the NIMS array, which also functioned as a ground plate for droplet actuation (FIG. 1B). The PDMS fluidic layer sealed reversibly to the array (FIG. 1B). The central channel has a dimension of 500 μm W×225 μm H). The glass layer (5 cm L×500 μm W×375 μm H) contained fluidic access ports and was coated with 128 chrome electrodes on the bottom side for directing droplets into pockets (FIG. 1A).

The reversible sealing nature of this technology allows droplets to be deposited onto the array (FIG. 1C), where the array (FIG. 1C layer iv) was aligned in direct contact with the DMF chip containing the glass, electrodes, dielectric and fluidic layers subsequently allowing removal and placement into the mass spectrometer (MS) for imaging. Briefly, the stack holding the layers were contained within layers 3D printed from polyethylene terephthalate glycol modified (PETG) (FIG. 1C, layers i and v.), where the bottom layer also contained pogo pins in printed circuit board for integration with dropbot DMF control hardware. An upper gasket made of PDMS sits between the 3D printed chassis and DMF chip to allow reversible sealing of PEEK tubing (FIG. 1C, layer ii.).

One design objective for the μNIMS device was to deposit sample solutions at specified two-dimensional locations on the NIMS array in a time dependent manner. The microfluidics chip consisted of chrome electrodes over a central fluidics channel (FIG. 1B). The chip contained two basic functions, a t-junction for droplet generation (FIG. 1A panel 1.), and 31 digital arrayers for droplet actuation over NIMS pads (1A panel 2.). The t-junction used pressure driven flow to break aqueous enzyme/substrate plugs into droplets of approximately 150 nl using immiscible oil phase similar to previous demonstration. The chip contained glass substrate, chrome electrodes, dielectric, and fluidics made the top of the stack for interfacing with the NIMS array, which also functioned as a ground plate during digital actuation (FIG. 1B). The PDMS fluidics layer sealed reversibly to the NIMS array allowing selective droplet actuation onto each NIMS pad (FIG. 1C). The final design loaded droplets in parallel, but the droplets could also be loaded serially if desired. The glass layer contained fluidic access ports and is coated with 124 chrome electrodes for directing droplets into pockets (FIG. 1B). The reversible seal between the fluidics chip and NIMS array allowed removal and placement into the mass spectrometer (MS) for imaging. Arrayers were aligned with NIMS pads (FIG. 1C layer iv.), which allowed droplets to be deposited onto the array (FIG. 1C). The stack holding the layers together was made of a 3D printed chassis (FIG. 1, layers I and v.), where the bottom layer also contained pogo pins in printed circuit board for integration with dropbot control hardware. An upper gasket made of PDMS sat between the 3D printed chassis and DMF chip to allow interfacing with PEEK tubing (FIG. 1C, layer ii.).

Altogether, these data demonstrate assembly of a microNTMS chip assembly of an integrated NIMS/D2D device.

Example 4

Use of a MicroNTMS Device

This example demonstrates use of a microNTMS device by controlling droplet formation and actuation on the microNTMS device.

Figure 2:
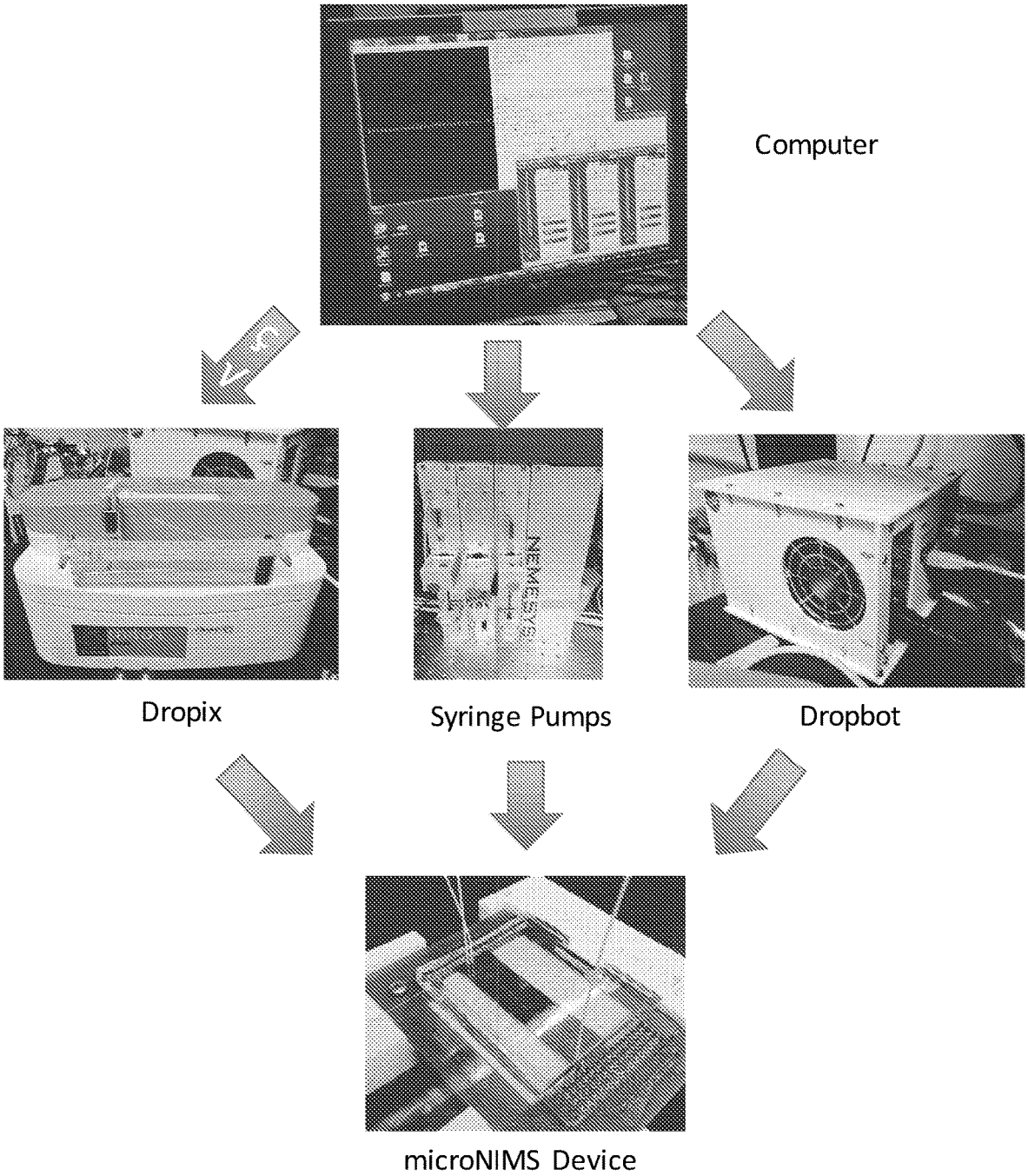
FIG. 2 shows a non-limiting exemplary microMS total control system.

The delivery of enzyme droplets to specified two-dimensional locations on the microNTMS was done using droplet-to-digital (D2D) handling protocols. The handling protocols contained flow based control information composed of pumping volumes, electrode actuation and timing. FIG. 2 shows a non-limiting exemplary microMS total control system. The microMS total control system, in particular a microNIMS total control system, with a custom hardware control structure consisted of a computer executing software for Mitos Dropix, syringe pumps and Dropbot, which were used to control droplet formation and actuation on the microNTMS device.

In the work sequence, plugs (5 μl) of enzyme solution were generated using a custom hardware control structure (FIG. 2). The plugs were pumped onto the microNTMS where they were broken into a 32 by ~150 nl droplet train using a T-junction (FIG. 1C panel i). Enzyme droplets traveled along central channel where they could be individually pulled from flow onto offsets by a four-electrode microMS pocket (FIG. 1C panel ii), which contained the NIMS array as the bottom ground plate for digital microfluidic (DMF) actuation (FIGS. 1G-H). The pre-coated microMS chip, in particular a pre-coated microNTMS chip, had enzyme droplets placed over pads to allow substrate conversion. FIG. 1G is a non-limiting exemplary schematic illustration of enzyme plugs created using the syringe pump to draw up sample into the tubing. Plugs were then injected onto the microNTMS system where they were broken into 150 nl droplets using the T-junction. FIG. 1H is a non-limiting exemplary schematic illustration showing droplets loaded onto microNTMS pads using chrome electrodes (500×225 mm) and Dropbot, which allowed multiple enzymes to be tested simultaneously.

The PDMS fluidic layer sealed reversibly to the array, where the central channel (500×225 μm) allowed selective droplet access to each microNTMS pocket. The glass layer contained fluidic access ports and was coated with 128 chrome electrodes on the bottom side for directing droplets into pockets (500×375 μm) (FIG. 1B). The reversible sealing nature between the PDMS fluidic layer and the array allowed droplets to be deposited onto the array (FIG. 1C), where the array (FIG. 1C layer iv) was placed into direct contact with the DMF chip containing the glass, electrodes, dielectric and fluidic layers subsequently allowing removal and placement into the MS for imaging. Briefly, the stack holding the layers were contained within layers 3D printed from polylactic acid (FIG. 1A layers i and v), where the bottom layer also contained pogo pins for integration with Dropbot DMF control hardware. An upper gasket made of PDMS sit between the 3D printed chassis and DMF chip to allow reversibly sealing of 1/32" PEEK tubing (FIG. 1A layer ii). Trailing and leading droplets, which have a high standard deviation in size (SD>10%) can be used to identify lead sequences requiring higher plug dead volume.

CellE, BGLA, and BGLB were loaded onto the device by prefilling tubing with plugs separated by 500-1000 nl of oil phase (FIG. 1A). Enzyme plugs were converted into droplets at the T-junction (flow rate: 0.05 μl/s acetate buffer, 0.2 μl/s HFE 7500). The flow based force used to break the plugs into droplets competed with the force of digital droplet actuation where unless flow was sufficiently low it would prevent droplet actuation into the microNTMS wells. Plugs were broken into droplets (32 s at 1 Hz). Digital droplet actuation sequences executed during and between flow sequences had long wait and hold sequences, with short bursts of fast actuation (100 ms). This fast actuation functioned to move droplets from the central chamber into the offset, which contained the NIMS active pads (FIG. 1C layer iv).

Figure 1D:
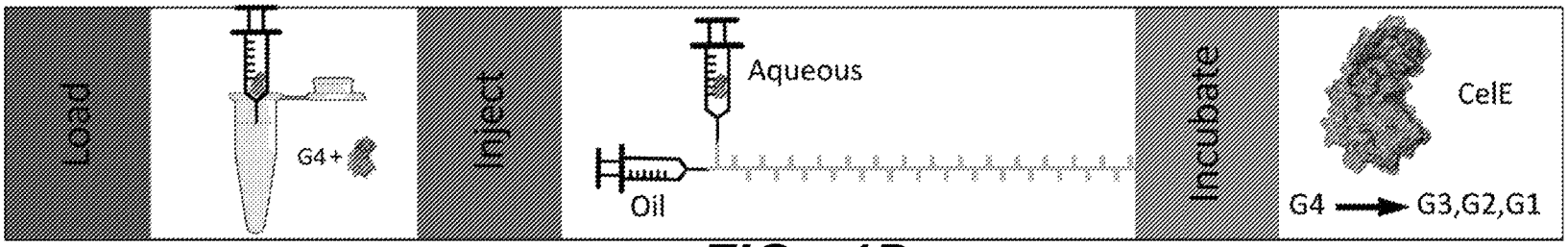
FIG. 1D shows a non-limiting exemplary schematic illustration of μNIMS workflow.
Figure 1E:
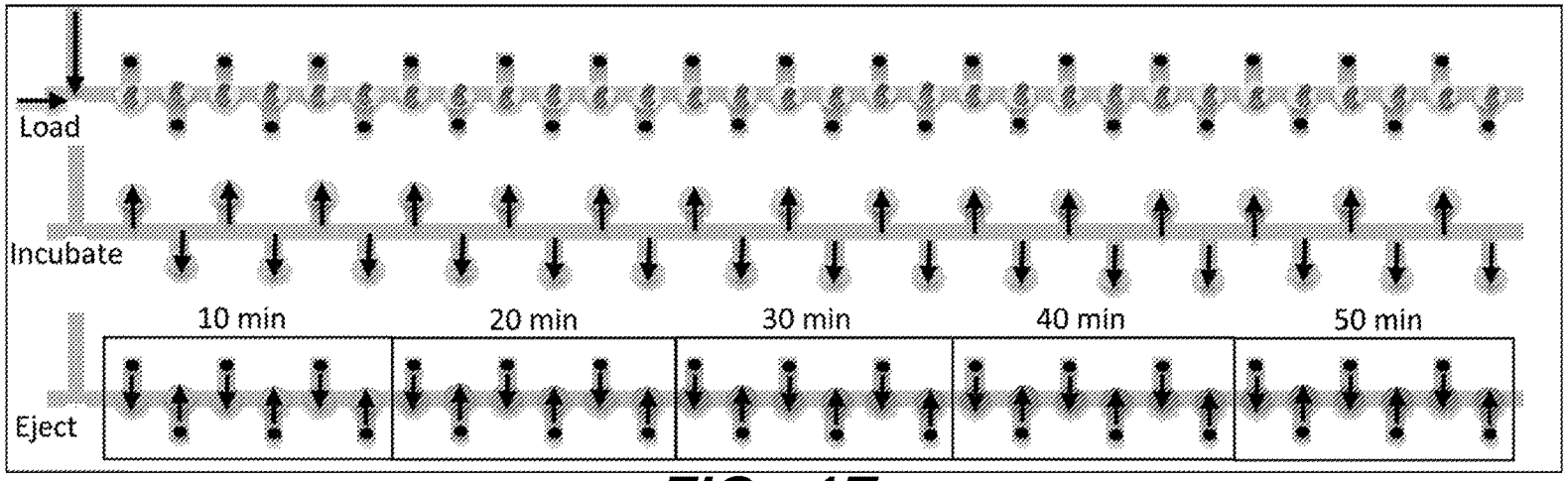
FIG. 1E shows a non-limiting exemplary schematic illustration of three operations of a μNIMS workflow: inject, incubate, and eject. Inject: chip is filled with droplets. Load: flow is stopped and droplets are loaded onto the NIMS array for incubation and probe deposition. Eject: the droplets are incubated for 10, 20, 30, and 40 minutes over six successive pads and then actuated into the central chamber where they are then evacuated.
Figure 1F:
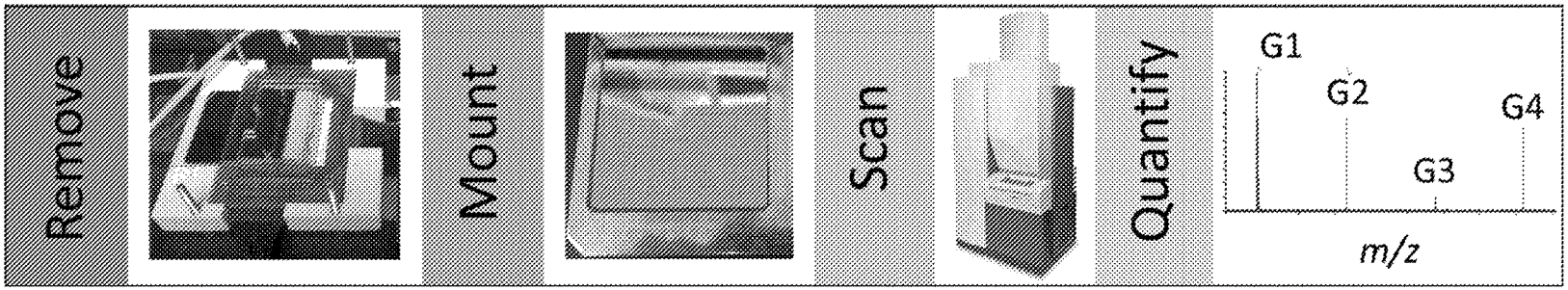
FIG. 1F shows a non-limiting exemplary schematic illustration of a μNIMS workflow, including array removal and analysis.
Figure 1G:
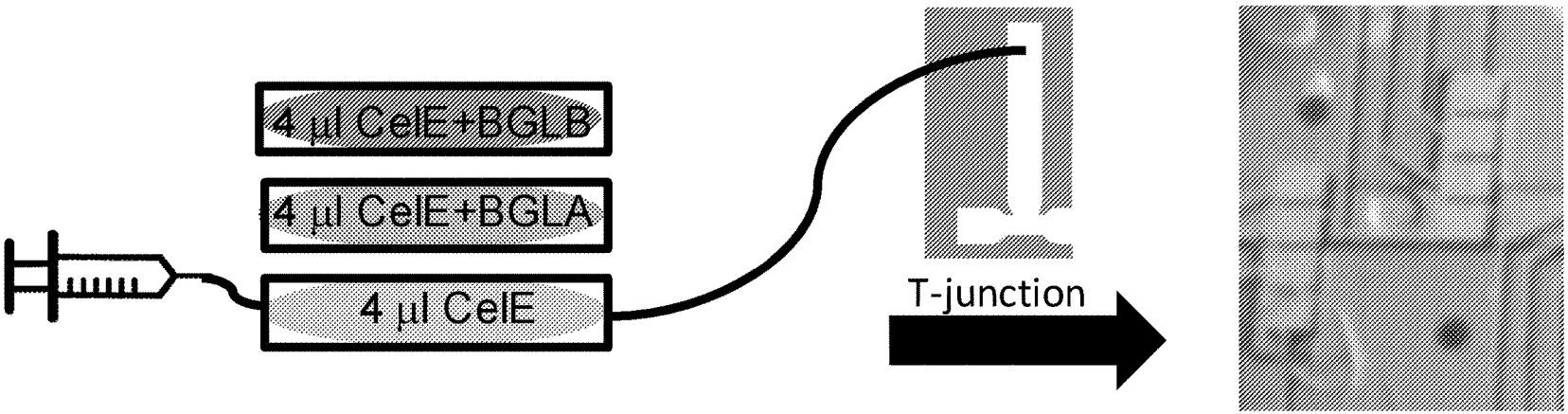
FIG. 1G is a non-limiting exemplary schematic illustration of enzyme plugs created using the syringe pump to draw up sample into the tubing.
Figure 1H:
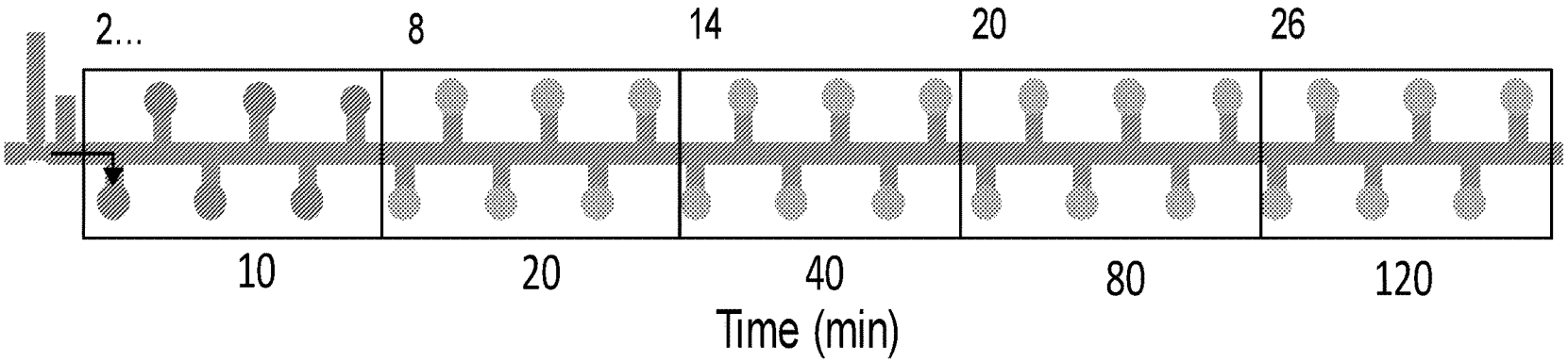
FIG. 1H is a non-limiting exemplary schematic illustration showing droplets being loaded onto microNTMS pads using chrome electrodes (500×225 mm) and Dropbot, which allowed multiple enzymes to be tested simultaneously.

CellE enzyme cocktail was loaded onto the device by filling syringe tubing with 6 μl plugs of pre-mixed enzyme substrate cocktail and injected onto the chip, where droplets were incubated (FIG. 1D). Plugs were broken into droplets at the t-junction and spaced using droplet synchronization, which matches droplet formation with the actuation of electrodes to create evenly spaced droplets. When the central chamber was filled with droplets syringe pumps are stopped while holding a low voltage (20 V) on the electrodes to hold droplets in position outside the pocket (FIG. 1E, load). Droplets of enzyme cocktail were then actuated onto the μNIMS pads where they were incubated for a period of time, this allowed G4 to be converted and sorbed to NIMS pad (FIG. 1E., incubate). At the specified time intervals, droplets were ejected from the pocket (FIG. 1E, eject). The incubation of the droplet over the pads on the NIMS array allowed substrates and products to sorb from the droplet. The digital actuation functioned to move droplets from the central chamber, in and out of the pocket containing the NIMS active pad allowing substrate and product to sorb. This was consistent with the normal operation of NIMS. Droplets are loaded after pausing flow in this experiment, but demonstrations show droplets can also be removed directly from flow if desired. MS imaging of the silicon wafer after exposure to standard revealed that fluorous tagged substrates stay adsorbed onto the NIMS pads in the microfluidic environment when incubating the droplet over a pad, similar to traditional NTMzyme execution.

CellE enzyme cocktail was loaded onto the device by prefilling tubing with 5 μl plugs of pre-mixed reaction. Enzyme plugs were broken into droplets at the t-junction (flow rate: 0.05 μl $s^{-1}$ reaction cocktail, 0.2 μl $s^{-1}$ HFE 7500) to fill the central fluidics chamber (FIG. 1E). The droplets were transported using flow, which competed with the force of digital droplet actuation, where unless flow was sufficiently low (or stopped) it would prevent droplet actuation into the micoNTMS wells. Once in position, droplets of enzyme cocktail were actuated onto all of the μNIMS pads where they were incubated for a period of time (FIG. 1E). At 10 min intervals, 6 droplets are synchronously removed (FIG. 1E). Protocols had long wait sequences, with short bursts of fast actuation (250 ms, 90 V, 10 000 Hz). This fast actuation functioned to move droplets from the central chamber, in and out of the pocket containing the NIMS active pad. Allowing substrate and product to sorb onto the NIMS. This was consistent with the normal operation of NIMS Altogether, these data demonstrates use of a microNIMS device. The μNIMS system was used for kinetic characterization of a glycoside hydrolase enzyme (CelE-CMB3A), a chimeric enzyme capable of deconstructing plant hemicellulose into monosaccharides for subsequent conversion to biofuel. This example reveals that NIMS nanostructures can be fabricated into arrays for microfluidic droplet deposition, NIMS is compatible with droplet and digital microfluidics, and can be used on-chip to assay glycoside hydrolase enzyme in vitro.

Example 5

NIMS Array Pads

This example demonstrates fabrication of NIMS pads using Reactive Ion Etching (DRIE).

Figure 3A:
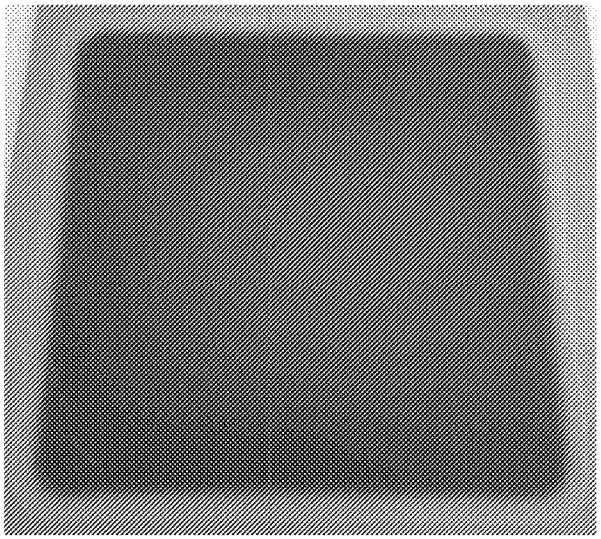
FIGS. 3A-3D show non-limiting exemplary MS arrays.
Figure 3B:
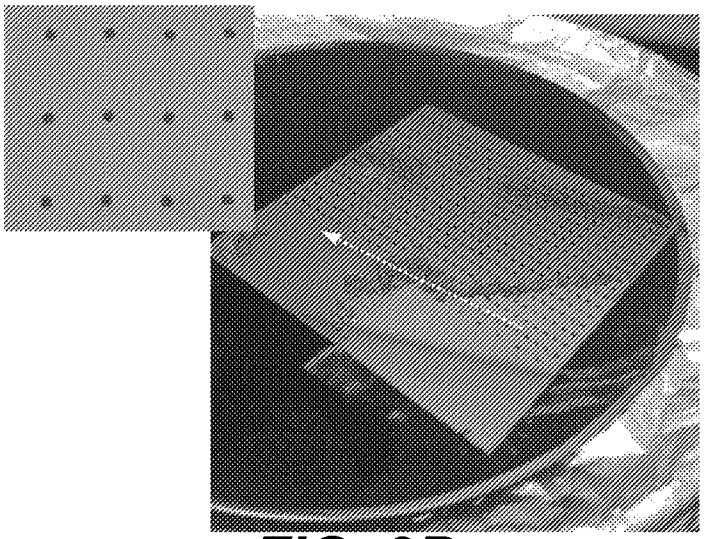
Figure 3C:
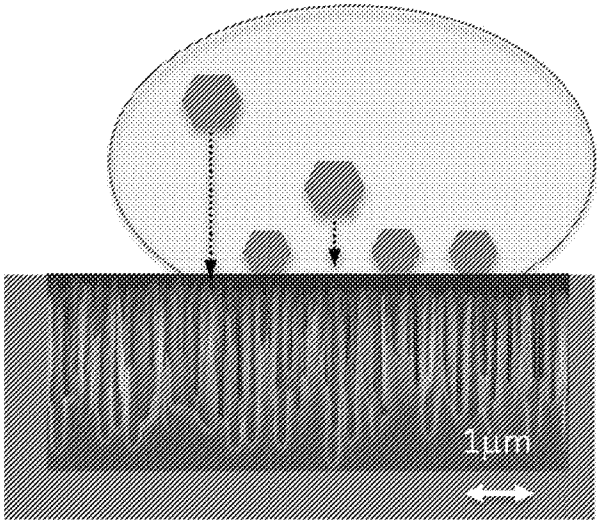
Figure 3D:
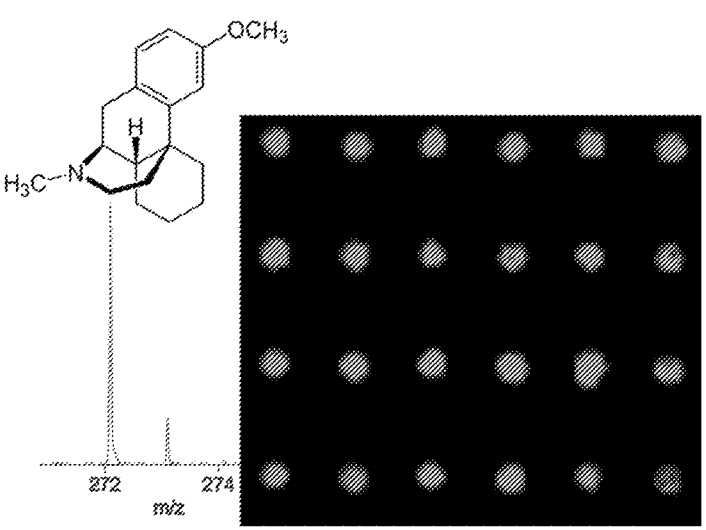

NIMS pads were fabricated using photopatternable PDMS as a protective gasket over a laser cut silicon wafer (5×5 $cm^2$) before it was exposed to Reactive Ion Etching (DRIE). FIGS. 3A-3D show non-limiting exemplary MS arrays. FIG. 3A is a non-limiting exemplary photograph of a conventional NIMS chip. FIG. 3B is a non-limiting exemplary photograph of patterned array of 640 microMS pads, in particular microNIMS pads, on silicon wafer. FIG. 3C shows a non-limiting exemplary scanning electron micrograph of nanostructures on surface of a MS chip, in particular a NIMS chip, after DRIE etching. FIG. 3D is a non-limiting mass spectral image of dextromethorphan (272 m/z) adsorbed onto surface of microNTMS pads.

Exposure etched the silicon wafer to create surface nanostructures (FIGS. 3B-3C), which actively ionized small molecules for detection-using laser desorption mass spectrometry (FIG. 3A), for NIMS analysis. To test the ability to deposit samples onto the NIMS pads and subsequently perform mass spectrometry analysis, the metabolite standard, dextromethorphan was used, where droplets were deposited over pads. Following deposition, the chip was removed and mass spectrometry imaging was performed to map dextromethorphan (m/z 272) across the surface. Subsequent processing using OpenMSI confirmed successful analyte deposition (FIG. 3D). Droplets of 1,4-b-D-cellotetraose-probe (G4) substrate were spotted onto the μNIMS pads during enzymatic reaction for confirmation of applicable use in monitoring cellulose degradation.

However, the ion intensities were low compared to the dextromethorphan and it was necessary to perform mass spectrometry imaging to detect all desired degradation products presumably due to suppression from the surfactant used to stabilize the droplets (FIG. 4A-4D). There was a noticeable decrease in sensitivity, possibly due to contaminants from surfactants and oil phase, which was overcome with addition of universal MALDI matrix (20 mg/ml) after chip removal. MS imaging of the silicon wafer after exposure to standard revealed that selective sorption of small molecules worked in the microfluidic environment when incubating aqueous sample droplet over a pad for 30 s.

Altogether, these data demonstrate fabrication of NIMS pads.

Example 6

Enzyme Kinetics of CelE

This example demonstrates use of microNTMS to quantify enzyme kinetics by coupling CelE, broad specificity GH hydrolase family 5 (GH5) domain from *C. thermocellum* (Cthe_0797).

Droplets of dexromethorphan (1 mg $ml^{-1}$ in H2O) were used for testing of microfluidic functions, and for NIMS array evaluation. Briefly 150 nl spots were actuated over NIMS pads to evaluate sorption of small molecules into the NIMS pads. Pads where dextromethorphan droplets were actuated showed clear ionization only on the NIMS pads not on surrounding structures. These results were matrix free, dextromethorphan ionization was sufficient using only NIMS.

Glucose can be used as a valuable substrate precursor in the production of clean bioenergy such as ethanol and other chemicals. Sugar cane, starch and cellulose can be the primary sources of glucose production, but may not be good sources to satisfy global demand, as this would require the use of large amounts of agricultural land. To overcome the need to pilfer land used in food production, the use of agricultural and forestry plant reserves can provide an attractive alternate to generation of cellulosic ethanol and other products.

The β-1,4 linked glucose polymer cellulose can be enzymatically hydrolyzed to glucose by endogluconase, exogluconase and β-glucosidase, which can cleave the β-1,4 glucosidic bonds of cellobiose to produce glucose. Thus these enzymes can be valuable targets for functional screening as they provide key steps in the generation of clean bioenergy from lignocellulosic biomass. The rate of lignocellulose hydrolysis to glucose enzymatically can be determined. During enzymatic hydrolysis, a buildup of cellobiose can occur if insufficient β-glucosidase activity was present, which in turn can repress both endogluconase and exogluconase activities. Therefore, optimized enzymatic activity can be desirable for efficient turnover of feedstocks to biofuel. This example demonstrates use of microNTMS to quantify enzyme kinetics by coupling CelE, broad specificity GH hydrolase family 5 (GH5) domain from *C. thermocellum* (Cthe_0797).

Figure 4A:
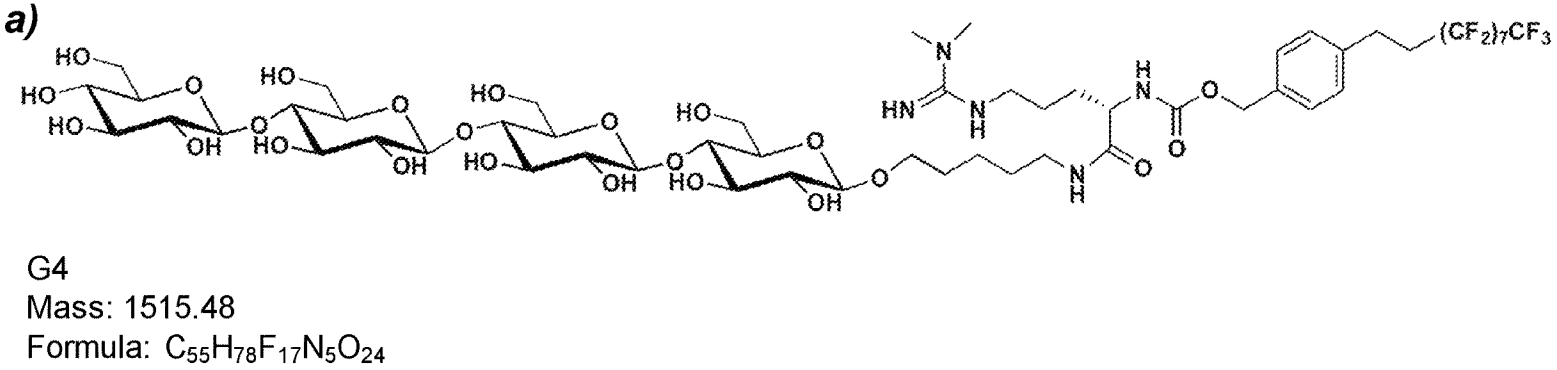
FIGS. 4A-4D show non-limiting exemplary enzyme substrates, products and mass spectra determined using microMS.
Figure 4B:
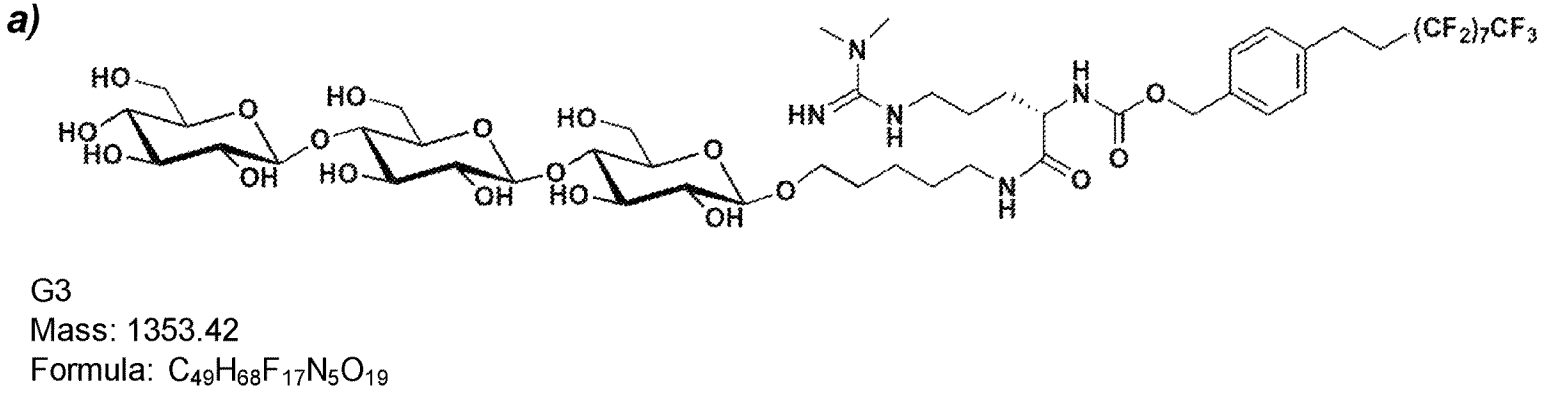
Figure 4C:
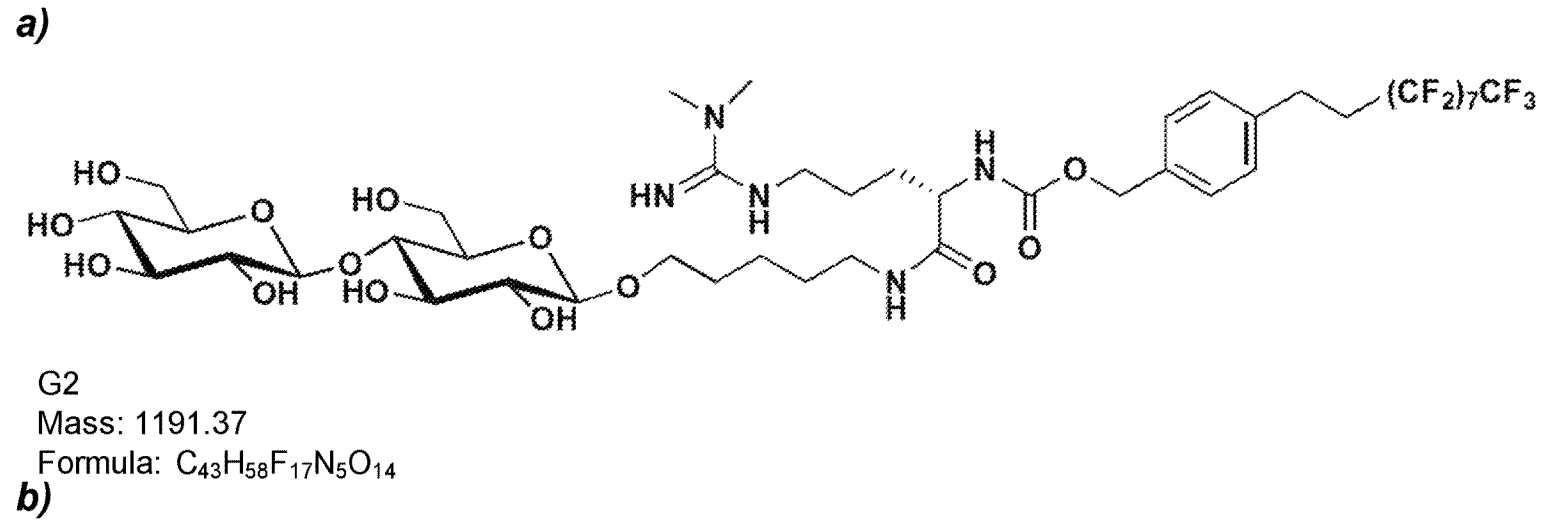
Figure 4D:
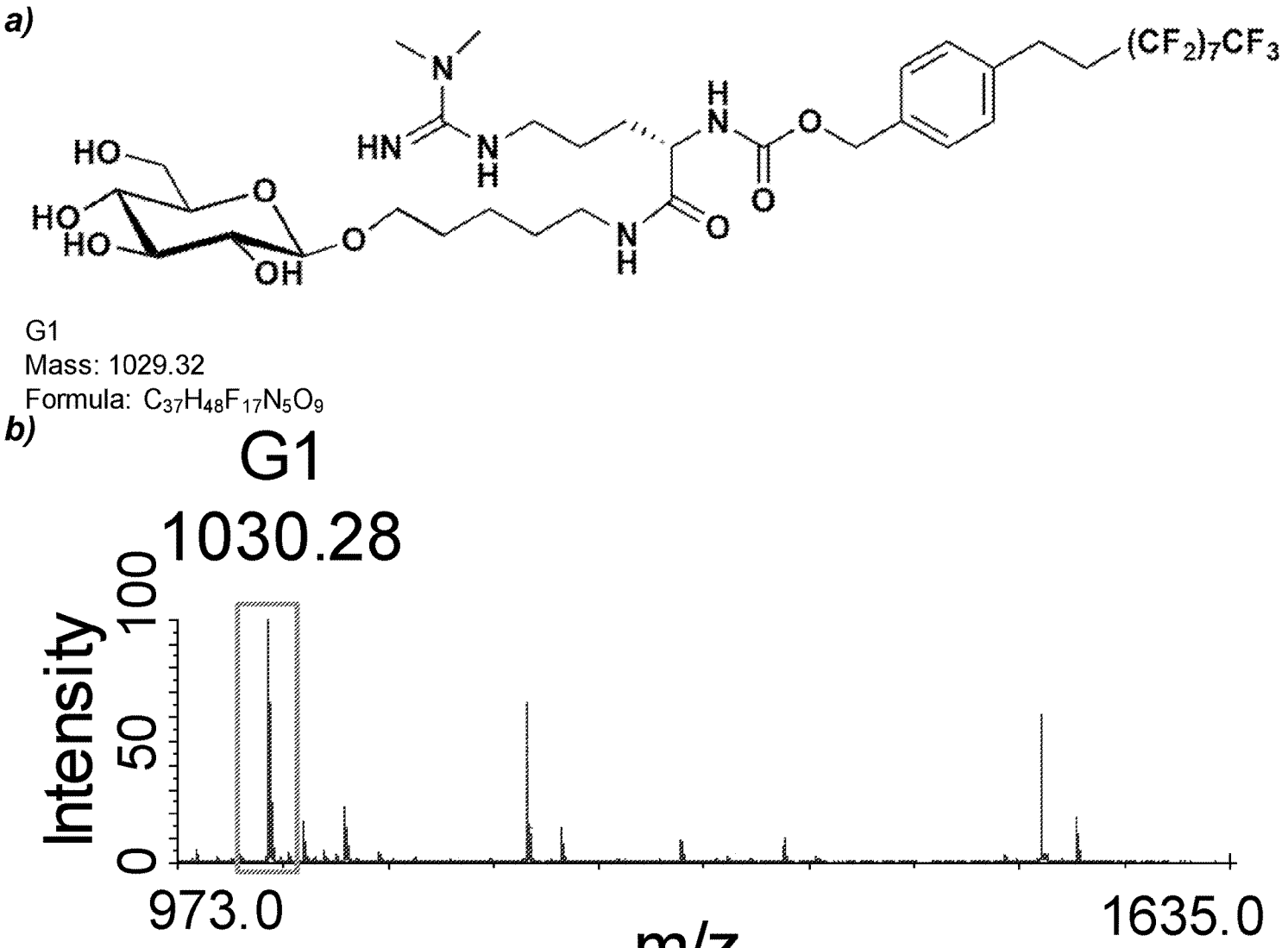

FIGS. 4A-4D show non-limiting exemplary enzyme substrates, products and mass spectra determined using microMS, in particular microNTMS. FIG. 4A shows the chemical structure of 1,4-β-D-cellotetraose-probe (G4) substrate (panel a) and a mass spectrum of G4 substrate with 1516 m/z (H+) (panel b). FIG. 4B shows the chemical structure of cellotriose-probe (G3) product (panel a) and a mass spectrum of G3 product with 1354 m/z (H+) (panel b). FIG. 4C shows the chemical structure of cellobiose-probe (G2) product (panel a) and a mass spectrum of G2 product with 1192 m/z (H+) (panel b). FIG. 4D shows the chemical structure of glucose-probe (G1) product (panel a) and a mass spectrum of G1 product with 1030 m/z (H+) (panel b).

The ability of microNIMS to deconstruct complex sugars into glucose provided a method for in vitro enzymatic coupling for visualizing synthetic metabolic flux. Purified endogluconase, CelE could convert 1,4-β-D-cellotetraose-probe (G4) substrate-probe G4 to G3 and subsequently G3 to G2 (FIGS. 4A-4D) as can be quantified using as matrix associated laser desorption ionization/time of flight (MALDI/TOF) to detect the masses of the substrates and products. Cellulose deconstruction was completed by using a β-glucosidase enzyme, which helped converting G2 to G1.

Figure 5A:
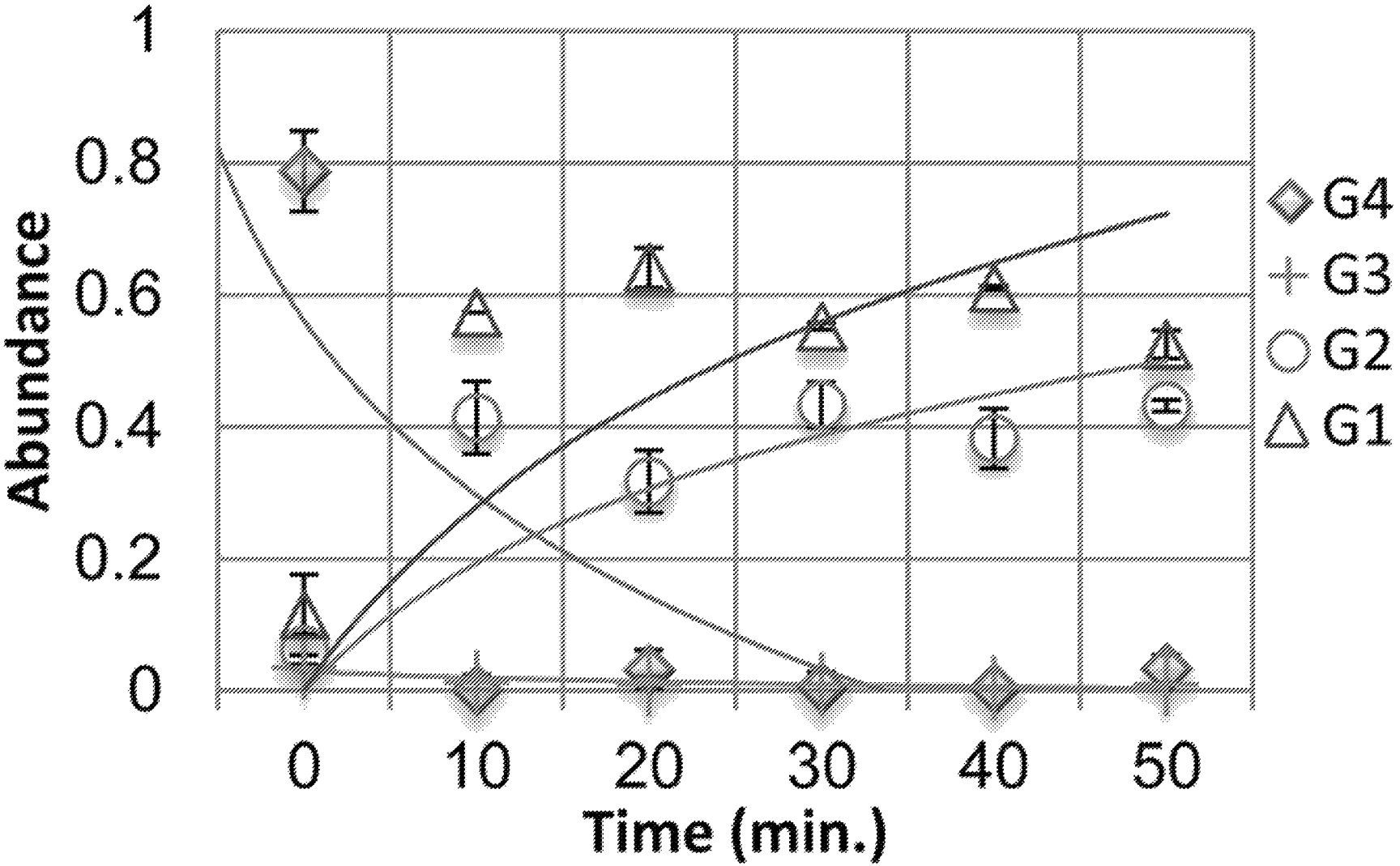
FIGS. 5A-5B are non-limiting plots showing enzyme kinetics of CelE as visualized by microMS.
Figure 5B:
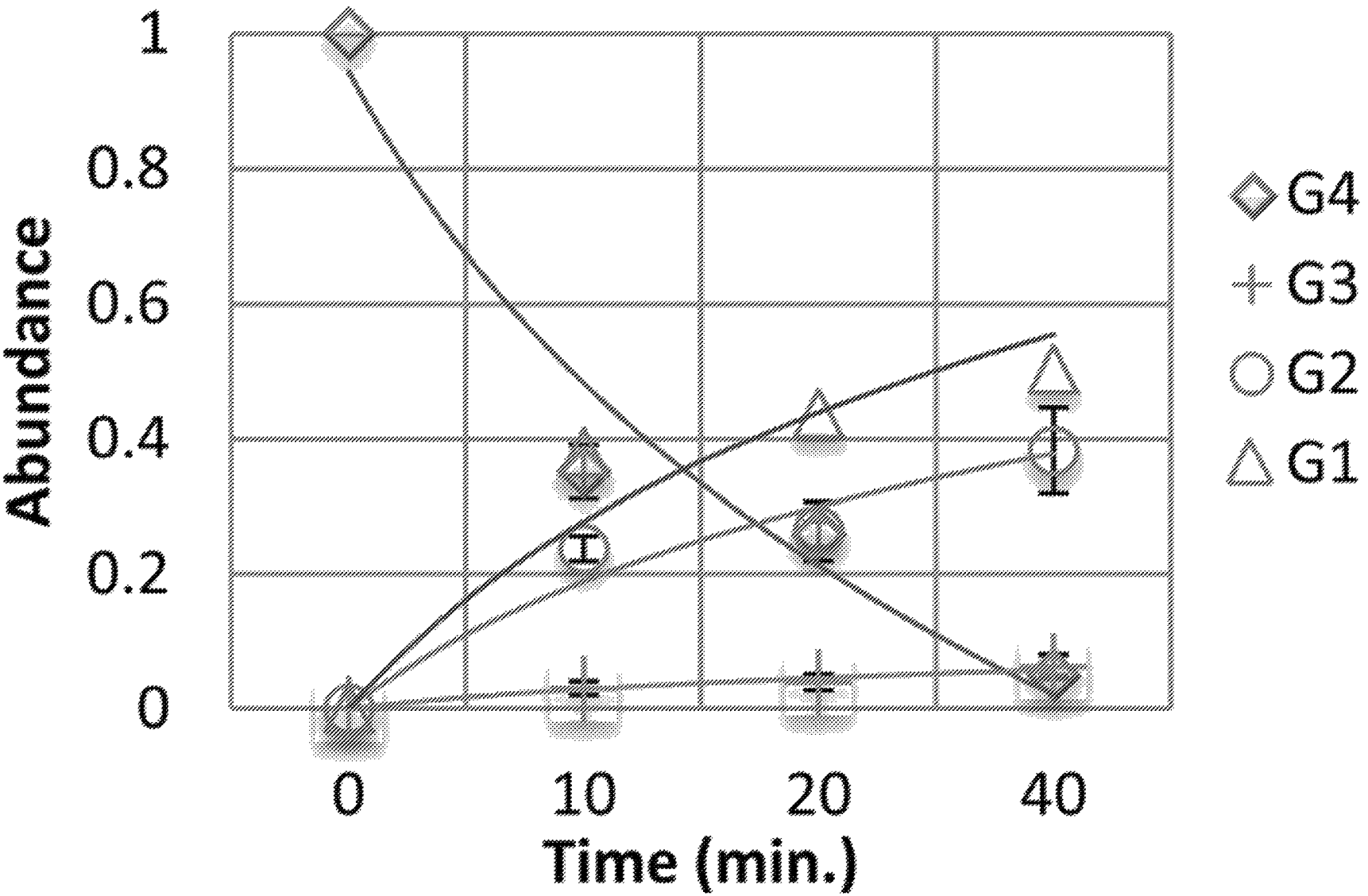

To evaluate the ability of microNTMS to be used to evaluate kinetics from an enzymatic cocktail, G4 probe substrate was incubated with CelE to allow G4 to be cleaved to products G3, G2 and G1. This cocktail was drawn into a plug and injected onto the microNTMS where it was broken into droplets, which were in turn parsed onto the NIMS array at different time points. Probe products and substrates desorb onto the NIMS pad by incubating the cocktail for 30 s. FIG. 5B is a non-limiting plot showing enzyme kinetics of CelE as visualized by microMS, in particular microNTMS. The turnover and capture of time points from CelE's deconstruction of G4 probe are shown in FIG. 5B. G4 was rapidly degraded into G3, G2 and G1 over the course of 40 minutes.

Purified endogluconase, CelE-CBM3a was reacted with 1,4-b-D-cellotetraose-probe (G4) substrate-probe G4 in either 50 mM phosphate buffer (pH=6) or 100 mM acetate buffer (pH=5) and analyzed every 10 min using μNIMS. Reaction solutions were premixed in an 0.5 ml eppendorf tube, by adding 4 μl buffer, 1 μl substrate and 1 μl CelE-CBM3a (CelE) enzyme (240 μg ml−1) and premixing to a final volume of 6 μl. A plug of 5 μl was drawn into tubing using syringe pumps and injected onto the μNIMS where plug was broken into droplets so it filled the central chamber, subsequently droplets were then actuated onto the NIMS pads. Reactions were performed at room temperature and droplets were removed from the pad at different times after reaction start as indicated in FIG. 4A-4D.

The ability of μNIMS to quantify enzyme kinetics was tested using a chimeric enzyme made up of a broad specificity GH hydrolase family 5 (GH5) domain from C. *Thermocellum* (Cthe_0797) fused onto a carbohydrate binding module, CBM3a (CelE). μNIMS was used to compare the reaction kinetics of, CelE, against cellotetraose at two different pHs. Briefly, purified endogluconase, CelE was reacted with 1,4-b-D-cellotetraose-probe (G4) substrate-probe G4 in either phosphate buffer (pH=6) (FIG. 5A) or 100 mM acetate buffer (pH=5) (FIG. 5B) and analysed every 10 min using μNIMS as described above. Reaction solutions were premixed in a 0.5 ml eppendorf tube, by adding buffer, substrate and enzyme and premixing to a final volume of 6 μl. The plug was drawn into the tubing and injected onto the μNIMS until droplets filled the central chamber. Droplets were then loaded onto the NIMS in parallel after halting flow (FIG. 5A), or continuously in series (FIG. 5B). Droplets were removed from the pad at different times after reaction start as indicated in FIG. 1E. Mass spectrometry imaging and OpenMSI analysis of the spotted array detected both the probe and three hydrolysis products (FIGS. 4A-4C) and kinetic analysis at both pH values the cellotetraose, G4, was rapidly degraded into G3, G2 and G1 over the course of 50 minutes (FIGS. 5A-5B). CelE was found to produce similar product distributions at both pH further indicating that it is robust to process conditions.

Mass spectral analysis was performed on a 5800 MALDI/TOF (ABSciex, US). The instrument was operated in positive ionization mode with a laser intensity of 4150 and focus mass of 1200 m/z. The NIMS array was imaged with a 50 μm laser step resolution after the chip was coated with universal MALDI matrix (20 mg/ml MeOH) using a TM-Sprayer (HTX Imaging). Data was processed using OpenMSI spot set analysis tools (O. Rubel, et al., Anal. Chem., 2013, 85(21), 10354-10361, the content of which is incorporated herein by reference in its entirety)

Altogether, these data demonstrate use of microNTMS to quantify enzyme kinetics.

In at least some of the previously described embodiments, one or more elements used in an embodiment can interchangeably be used in another embodiment unless such a replacement is not technically feasible. It will be appreciated by those skilled in the art that various other omissions, additions and modifications may be made to the methods and structures described above without departing from the scope of the claimed subject matter. All such modifications and changes are intended to fall within the scope of the subject matter, as defined by the appended claims.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible sub-ranges and combinations of sub-ranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into sub-ranges as discussed above. Finally, as will be understood by one skilled in the art, a range includes each individual member. Thus, for example, a group having 1-3 articles refers to groups having 1, 2, or 3 articles. Similarly, a group having 1-5 articles refers to groups having 1, 2, 3, 4, or 5 articles, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A device for detecting compounds in microfluidic droplets using mass spectrometry, comprising:

a microfluidic device comprising a droplet-to-digital microfluidic device, wherein the droplet-to-digital microfluidic device comprises:

a glass layer;

an electrode layer;

a dielectric layer; and a microfluidics layer; and a nanostructure-initiator mass spectrometry plate, wherein the nanostructure-initiator mass spectrometry plate is reversibly sealed to the microfluidic device.

2. The device of claim 1, wherein the glass layer is on a first side of the electrode layer, wherein the dielectric layer is on a second side of the electrode layer, wherein the electrode layer is on a first side of the dielectric layer, wherein the microfluidics layer is on a second side of the dielectric layer, wherein the dielectric layer is on a first side of the microfluidics layer, and wherein the nanostructure-initiator mass spectrometry plate is on a second side of the microfluidics layer.

3. The device of claim 2, wherein the electrode layer comprises electrodes etched onto one side of the glass layer.

4. The device of claim 3, wherein the electrodes comprise chrome electrodes.

5. The device of claim 1, wherein the electrode layer is configured to manipulate droplets in the microfluidics layer, and wherein the dielectric layer is configured for electrowetting.

6. The device of claim 1, wherein the glass layer comprises fluidic access ports.

7. The device of claim 1, wherein the microfluidics layer comprises channels, wherein depths of some of the channels are about 5-250 μm, and wherein widths of some of the channels are 5-500 μm.

8. The device of claim 7, wherein the microfluidics layer comprises a droplet generator, wherein the droplet generator is connected to the channels.

9. The device of claim 8, wherein the droplet generator comprises a T-junction droplet generator.

10. The device of claim 7, wherein the microfluidics layer comprises pockets connected to the channels of the microfluidics layer.

11. The device of claim 1, wherein the nanostructure-initiator mass spectrometry plate is reversibly sealed to the microfluidic device with a rubbery seal at 1.5-9 MPa.

12. The device of claim 1, wherein the nanostructure-initiator mass spectrometry plate is reversibly sealed at a pressure higher than an inner pressure of the microfluidics device.

13. A method for detecting compounds in droplets using mass spectrometry, comprising:

providing a microfluidics-mass spectrometry (microMS) device, comprising:

a droplet-to-digital microfluidic device, wherein the droplet-to-digital microfluidic device comprises:

a glass layer, wherein the glass layer comprises fluidic access ports;

an electrode layer, wherein the electrode layer comprises chrome electrodes etched onto one side of the glass layer;

a dielectric layer, wherein the dielectric layer is configured for electrowetting; and a microfluidics layer, wherein the microfluidics layer comprises channels, pockets, and a droplet generator, wherein the pockets are connected to the channels;

a nanostructure-initiator mass spectrometry plate, wherein the nanostructure-initiator mass spectrometry plate is reversibly sealed to the microfluidic device; and producing droplets comprising one or more compounds using the droplet generator of the microMS device; and generating mass spectra for the droplets to detect one or more compounds in the droplets.

14. The method of claim 13, wherein the glass layer is on a first side of the electrode layer, wherein the dielectric layer is on a second side of the electrode layer, wherein the electrode layer is on a first side of the dielectric layer, wherein the microfluidics layer is on a second side of the dielectric layer, wherein the dielectric layer is on a first side of the microfluidics layer, and wherein the nanostructure-initiator mass spectrometry plate is on a second side of the microfluidics layer.

15. The method of claim 13, further comprising manipulating the droplets generated using the electrode layer, wherein manipulating the droplets using the electrode layer comprises splitting at least one of the droplets, mixing at least two of the droplets, moving at least one of the droplets, or a combination thereof.

16. The method of claim 13, wherein the nanostructure-initiator mass spectrometry plate comprises micropatterns, the method further comprising:

aligning the nanostructure-initiator mass spectrometry plate with the microfluidics device to allow targeted droplet deposition using the micropatterns.

17. The method of claim 13, wherein the nanostructure-initiator mass spectrometry plate comprises at least 640 mass spectrometry pads, and wherein the microfluidics layer comprises at least 640 pockets.

18. The method of claim 17, further comprising depositing the droplets into the pockets, wherein the volume of at least one of the one or more mixtures is about 1 microliter, about 1 nanoliter, or about 1 picoliter.

19. The method of claim 17, further comprising manipulating the droplets from the pockets into the mass spectrometry pads.

* * * * *